US011294320B2

(12) United States Patent
Shibuya et al.

(10) Patent No.: US 11,294,320 B2
(45) Date of Patent: Apr. 5, 2022

(54) IMAGE FORMING APPARATUS

(71) Applicant: CANON KABUSHIKI KAISHA, Tokyo (JP)

(72) Inventors: Ryota Shibuya, Kanagawa (JP); Goshi Ozaki, Kanagawa (JP); Yusuke Kai, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/027,077

(22) Filed: Sep. 21, 2020

(65) Prior Publication Data

US 2021/0096497 A1 Apr. 1, 2021

(30) Foreign Application Priority Data

Sep. 30, 2019 (JP) ..... JP2019-180286
Aug. 3, 2020 (JP) ..... JP2020-131914

(51) Int. Cl.
*G03G 15/00* (2006.01)
*G03G 21/16* (2006.01)
*G03G 21/18* (2006.01)

(52) U.S. Cl.
CPC ..... *G03G 15/757* (2013.01); *G03G 21/1647* (2013.01); *G03G 21/186* (2013.01); *G03G 21/1864* (2013.01); *G03G 2221/1657* (2013.01)

(58) Field of Classification Search
CPC ..... G03G 15/757; G03G 21/1633; G03G 21/1647; G03G 21/1825; G03G 21/186; G03G 21/1864; G03G 2221/1657
See application file for complete search history.

(56) References Cited

U.S. PATENT DOCUMENTS 10,126,702 B1 * 11/2018 Triplett ..... G03G 21/1647
2007/0059038 A1 * 3/2007 Shiraki ..... G03G 21/1647 399/119
2009/0179513 A1 * 7/2009 Cho ..... G03G 21/1647 310/91
2009/0322020 A1 * 12/2009 Iwata ..... G03G 15/757 271/314

(Continued)

FOREIGN PATENT DOCUMENTS

JP 2017-223802 A 12/2017
JP 2018-4818 A 1/2018

(Continued)

*Primary Examiner* — Francis C Gray
(74) *Attorney, Agent, or Firm* — Canon U.S.A., Inc. I.P. Division

(57) ABSTRACT

An image forming apparatus includes an apparatus body including a mounting portion, a drive transmission member provided on the apparatus body, and a cover portion configured to cover the drive transmission member. The mounting portion is configured to accommodate a cartridge including an input coupling portion and an input gear portion. The drive transmission member includes an output coupling portion configured to engage with the input coupling portion, and an output gear portion configured to engage with the input gear portion. The cover portion is located between the mounting portion and the drive transmission member and includes a first opening configured to expose the output coupling portion, and a second opening configured to expose the output gear portion.

22 Claims, 29 Drawing Sheets

(56) References Cited

U.S. PATENT DOCUMENTS

| | | | | |
|---|---|---|---|---|
| 2012/0190489 | A1* | 7/2012 | Takagi | G03G 21/1647 474/148 |
| 2014/0123796 | A1* | 5/2014 | Ishida | G03G 15/00 74/421 A |
| 2016/0252847 | A1* | 9/2016 | Sato | G03G 21/186 399/167 |
| 2016/0274526 | A1* | 9/2016 | Ochi | G03G 21/1864 |
| 2016/0378049 | A1* | 12/2016 | Tomita | G03G 21/1647 399/167 |
| 2017/0045856 | A1* | 2/2017 | Kawai | G03G 15/757 |

FOREIGN PATENT DOCUMENTS

| | | | |
|---|---|---|---|
| JP | 2018-120076 | A | 8/2018 |
| JP | 2019-105750 | A | 6/2019 |

* cited by examiner

IMAGE FORMING APPARATUS

BACKGROUND OF THE INVENTION

Field of the Invention

The present invention relates to an image forming apparatus, and more particularly, to an electrophotographic image forming apparatus that forms an image on a recording medium by an electrophotographic image forming method.

Examples of the electrophotographic image forming apparatus include an electrophotographic copying machine, an electrophotographic printer (a light-emitting diode (LED) printer, a laser printer, etc.), a facsimile apparatus, and a word processor.

Description of the Related Art

In an electrophotographic image forming apparatus (hereinafter also referred to simply as an "image forming apparatus"), an electrophotographic photosensitive member serving as an image carrying member, that is, a photosensitive drum, is used. In the case of forming an image on a recording material, the surface of the photosensitive drum is first charged. The charged photosensitive drum is exposed to light, so that an electrostatic latent image (electrostatic image) is formed on the surface of the photosensitive drum. The electrostatic latent image formed on the surface of the photosensitive drum is developed as a toner image by using toner as developer. The toner image formed on the surface of the photosensitive drum is transferred onto a recording material, such as a recording sheet or a plastic sheet, and heat and pressure are applied to the toner image transferred onto the recording material, to thereby fix the toner image onto the recording material.

Such an image forming apparatus generally requires replenishment of toner and maintenance for various process units (such as a photosensitive drum, a charging unit, a development unit, and a cleaning unit). To facilitate the replenishment of toner and maintenance, process cartridges which are made by collectively configuring various process units and which are configured to be detachably mounted on the main body of the image forming apparatus are being put to practical use.

As an example of the image forming apparatus described above, an image forming apparatus discussed in Japanese Patent Application Laid-Open No. 2019-105750 is known. Japanese Patent Application Laid-Open No. 2019-105750 discusses a drive transmission member for transmitting a driving force to a process cartridge from the main body of the image forming apparatus. The drive transmission member is provided with an output coupling and an output gear. A process cartridge configured to be detachably mounted on the apparatus body is provided with an input coupling that engages with the output coupling to receive a rotational force, and an input gear that engages with the output gear to receive a rotational force.

To prevent the drive transmission member of the image forming apparatus from being worn, lubricant can be coated on the drive transmission member. Accordingly, the drive transmission member may be configured to prevent a user from easily touching the drive transmission member.

SUMMARY OF THE INVENTION

The present invention is directed to providing an image forming apparatus capable of preventing a user from touching a drive transmission member.

According to an aspect of the present invention, an image forming apparatus includes an apparatus body including a mounting portion, the mounting portion being configured to accommodate a cartridge including an input coupling portion and an input gear portion, a drive transmission member configured to transmit a driving force to the cartridge, the drive transmission member being provided on the apparatus body and including an output coupling portion and an output gear portion, the output coupling portion being configured to engage with the input coupling portion and to be rotatable about a first axis, the output gear portion being configured to mesh with the input gear portion and to be rotatable about the first axis, the drive transmission member being coated with lubricant, and a cover portion configured to cover the drive transmission member, the cover portion being provided on the apparatus body and being located between the mounting portion and the drive transmission member, the cover portion including a first opening configured to expose the output coupling portion to allow the engagement of the output coupling portion with the input coupling portion, the cover portion including a second opening configured to expose the output gear portion to allow the meshing of the output gear portion with the input gear portion.

According to another aspect of the present invention, an image forming apparatus includes an apparatus body including a mounting portion, the mounting portion being configured to accommodate a cartridge including an input coupling portion and an input gear portion, a drive transmission member configured to transmit a driving force to the cartridge, the drive transmission member being provided on the apparatus body and including an output coupling portion and an output gear portion, the output coupling portion being configured to engage with the input coupling portion and to be rotatable about a first axis, the output gear portion being configured to mesh with the input gear portion and to be rotatable about the first axis, the drive transmission member being configured to be supplied with lubricant from the cartridge, and a cover portion configured to cover the drive transmission member, the cover portion being provided on the apparatus body and being located between the mounting portion and the drive transmission member, the cover portion including a first opening configured to expose the output coupling portion to allow the engagement of the output coupling portion with the input coupling portion, the cover portion including a second opening configured to expose the output gear portion to allow the meshing of the output gear portion with the input gear portion.

Further features of the present invention will become apparent from the following description of exemplary embodiments with reference to the attached drawings.

DESCRIPTION OF THE EMBODIMENTS

Exemplary embodiments of the present invention will be described in detail below with reference to the drawings.

Figure 1:
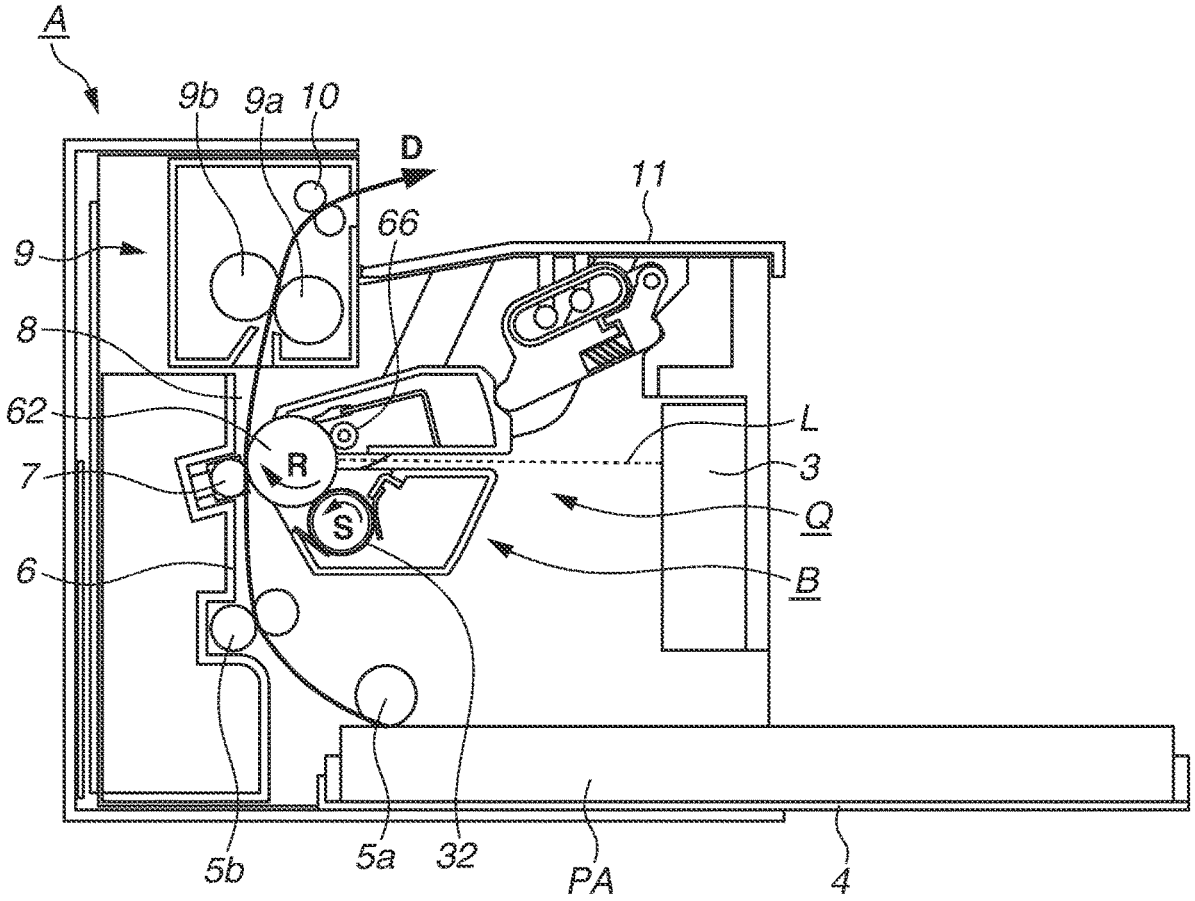
FIG. 1 is a sectional view illustrating an apparatus body of an image forming apparatus and a cartridge according to a first exemplary embodiment.
Figure 2:
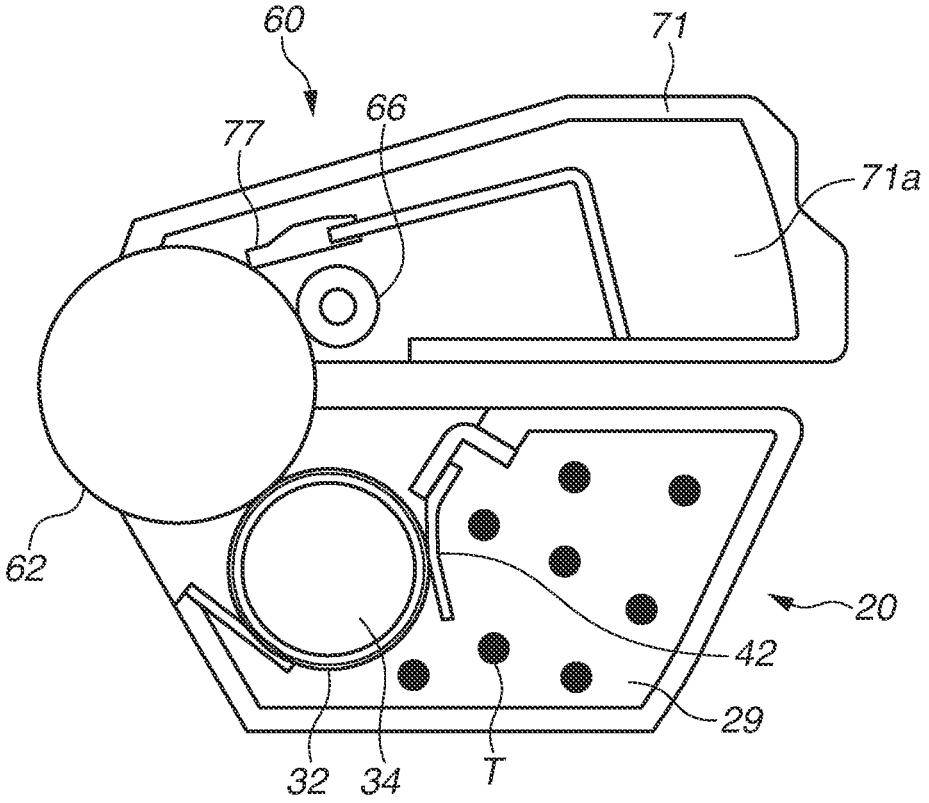
FIG. 2 is a sectional view illustrating the cartridge according to the first exemplary embodiment.

A first exemplary embodiment will be described. An overall configuration and an image forming process will now be described with reference to FIGS. 1 and 2. FIG. 1 is a sectional view illustrating an apparatus body (electrophotographic image forming apparatus body, image forming apparatus body) A of an electrophotographic image forming apparatus according to the first exemplary embodiment of the present invention and a process cartridge (hereinafter referred to as a cartridge B). FIG. 2 is a sectional view of the cartridge B.

The apparatus body A described herein refers to a portion of the electrophotographic image forming apparatus excluding the cartridge B.

<Overall Configuration of Image Forming Apparatus>

The electrophotographic image forming apparatus (image forming apparatus) illustrated in FIG. 1 is a laser beam printer that uses an electrophotographic technique.

The image forming apparatus includes the apparatus body A. In the apparatus body A, a mounting portion (space for accommodating the cartridge) Q that is configured to allow mounting of the cartridge B is formed. The cartridge B is configured to be detachably mounted on the mounting portion Q of the apparatus body A. In other words, the mounting portion Q is configured to accommodate the cartridge B. The apparatus body A includes an exposure device 3 (laser scanner unit). The cartridge B includes a photosensitive drum 62 serving as an image carrying member (photosensitive member). The exposure device 3 forms an electrostatic latent image on the surface of the photosensitive drum 62 of the cartridge B when the cartridge B is mounted on the apparatus body A. A sheet tray 4 in which a sheet material PA, which is a recording medium (recording material) on which an image is to be formed is accommodated is disposed below the cartridge B.

Further, in the apparatus body A, a pickup roller 5*a*, a feed roller pair 5*b*, a transfer guide 6, a transfer roller 7, a conveyance guide 8, a fixing device 9, a discharge roller pair 10, a discharge tray 11, and the like are arranged along a conveyance direction D of the sheet material PA. The fixing device 9 is composed of a heating roller 9*a* and a pressure roller 9*b*.

A direction of a rotation axis of the photosensitive drum 62 in a state where the cartridge B is mounted on the mounting portion Q is hereinafter referred to as a longitudinal direction. In the longitudinal direction, a side where the photosensitive drum 62 receives a driving force from the apparatus body A is referred to as a driving side, and a side opposite to the driving side is referred to as a non-driving side.

<Image Forming Processing>

Next, an outline of the image forming process will be described with reference to FIGS. 1 and 2.

As illustrated in FIG. 1, the photosensitive drum 62 is rotated in a direction indicated by an arrow R at a predetermined circumferential speed (process speed) based on a print start signal.

As illustrated in FIGS. 1 and 2, the cartridge B includes a charging roller (charging member) 66 to which a voltage is applied from a power supply of the apparatus body A. The charging roller 66 contacts the outer peripheral surface of the photosensitive drum 62 and charges the outer peripheral surface of the photosensitive drum 62.

The exposure device 3 outputs a laser beam L based on image information. The laser beam L passes through a laser opening, which is provided in the cartridge B, to scan and expose the outer peripheral surface of the photosensitive drum 62 to light. As a result, an electrostatic latent image corresponding to the image formation is formed on the outer peripheral surface of the photosensitive drum 62.

On the other hand, as illustrated in FIG. 2, the cartridge B includes a development unit 20 as a development device. The development unit 20 includes a toner chamber 29, which contains toner T as developer, a magnet roller 34, a development roller 32, and a development blade 42 serving as a layer thickness regulation member. The toner T contained in the toner chamber 29 is carried on the surface of the development roller 32 by a magnetic force of the magnet roller 34 (stationary magnet). The development roller 32 is a developer carrying member on which the developer (toner T) is carried to develop the electrostatic latent image formed on the surface of the photosensitive drum 62.

When the development roller 32 is rotated in a direction indicated by an arrow S, the toner T is triboelectrically charged by the development blade 42 and the thickness of a toner layer formed on the development roller 32 is regulated.

The toner T is supplied to the photosensitive drum 62 based on the electrostatic latent image, and the electrostatic latent image is developed. Thus, the electrostatic latent image is formed into a visible image as a toner image. The photosensitive drum 62 is an image carrying member (photosensitive member) on which the electrostatic latent image and images (such as a toner image and a developer image) to be formed with toner are carried.

In accordance with a timing of outputting the laser beam L, the sheet material PA is delivered from the sheet tray 4 by the pickup roller 5*a* and the feed roller pair 5*b*. The sheet material PA passes through the transfer guide 6 and is conveyed to a transfer position between the photosensitive drum 62 and the transfer roller 7. At the transfer position, the toner image is transferred from the surface of the photosensitive drum 62 onto the sheet material PA.

The sheet material PA onto which the toner image is transferred is separated from the photosensitive drum 62 and is conveyed to the fixing device 9 along the conveyance guide 8. Then, the sheet material PA passes through a nip portion between the heating roller 9*a* and the pressure roller 9*b* of the fixing device 9. In this nip portion, a pressure/heating fixation process is carried out to fix the toner image onto the sheet material PA. The sheet material PA subjected to the toner image fixation process is conveyed to the discharge roller pair 10 and is then discharged onto the discharge tray 11.

If the sheet material PA gets jammed in the apparatus body A, an opening/closing door 13 to be described below is open and the cartridge B is detached from the mounting portion Q, so that the sheet PA can be removed through the mounting portion Q.

As illustrated in FIG. 2, the cartridge B includes the photosensitive drum 62, a cleaning blade 77 serving as a cleaning member, the charging roller 66, and a photosensitive member unit 60 including a drum frame 71 that supports the photosensitive drum 62, the cleaning blade 77, and the charging roller 66. Residual toner remaining on the surface of the photosensitive drum 62 after the sheet material PA has passed through the transfer position is removed by the cleaning blade 77. The residual toner removed from the surface of the photosensitive drum 62 is stored in a removed toner chamber 71*a* provided in the drum frame 71.

In the present exemplary embodiment, the charging roller 66, the development roller 32, the transfer roller 7, and the cleaning blade 77 are process units that act on the photosensitive drum 62. Among these process units, the charging roller 66, the development roller 32, and the cleaning blade 77 are included in the cartridge B.

<Opening/Closing Door and Drive Transmission Member in Apparatus Body>

Next, a relationship between a drive transmission member 81 and an opening/closing operation of the opening/closing door 13 when the cartridge B is mounted or dismounted will be described in detail with reference to FIGS. 3A, 3B, 4, and 5.

Figure 3A:
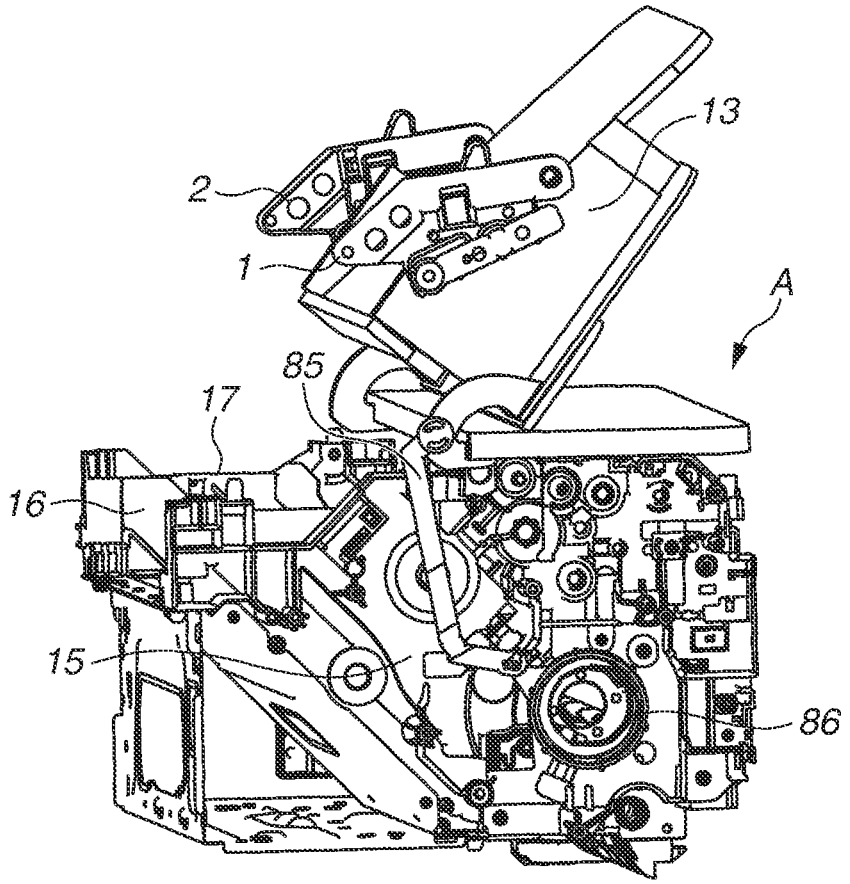
FIG. 3A is a perspective view illustrating the apparatus body in a state where an opening/closing door according to the first exemplary embodiment is open.
Figure 3B:
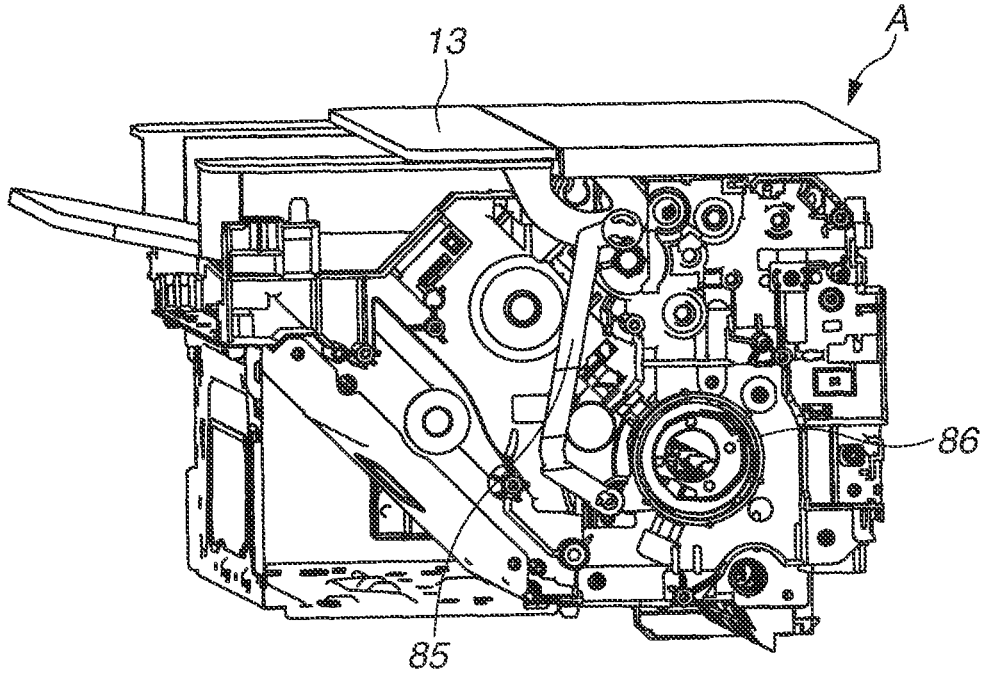
FIG. 3B is a perspective view illustrating the apparatus body in a state where the opening/closing door according to the first exemplary embodiment is closed.
Figure 4:
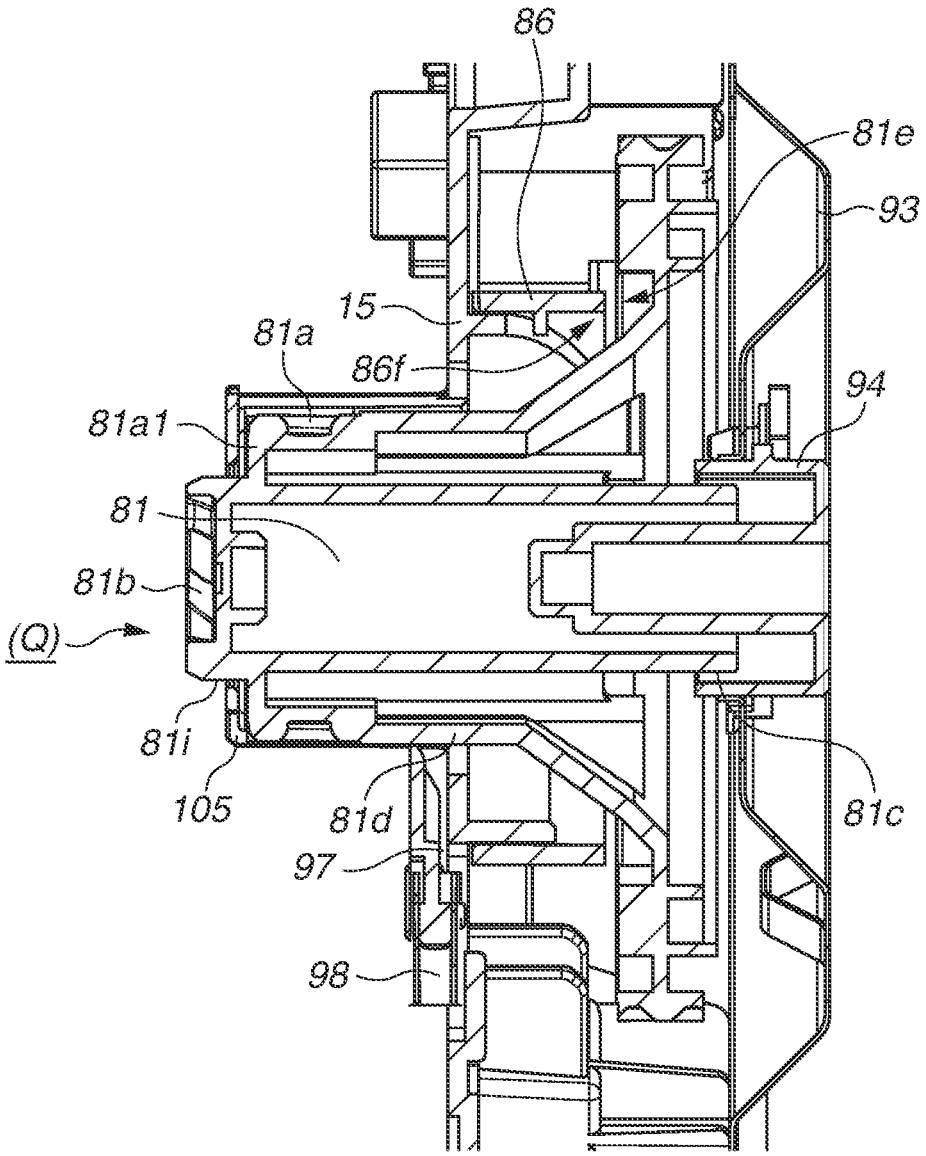
FIG. 4 is a sectional view illustrating a drive transmission member in a state where the opening/closing door according to the first exemplary embodiment is closed.
Figure 5:
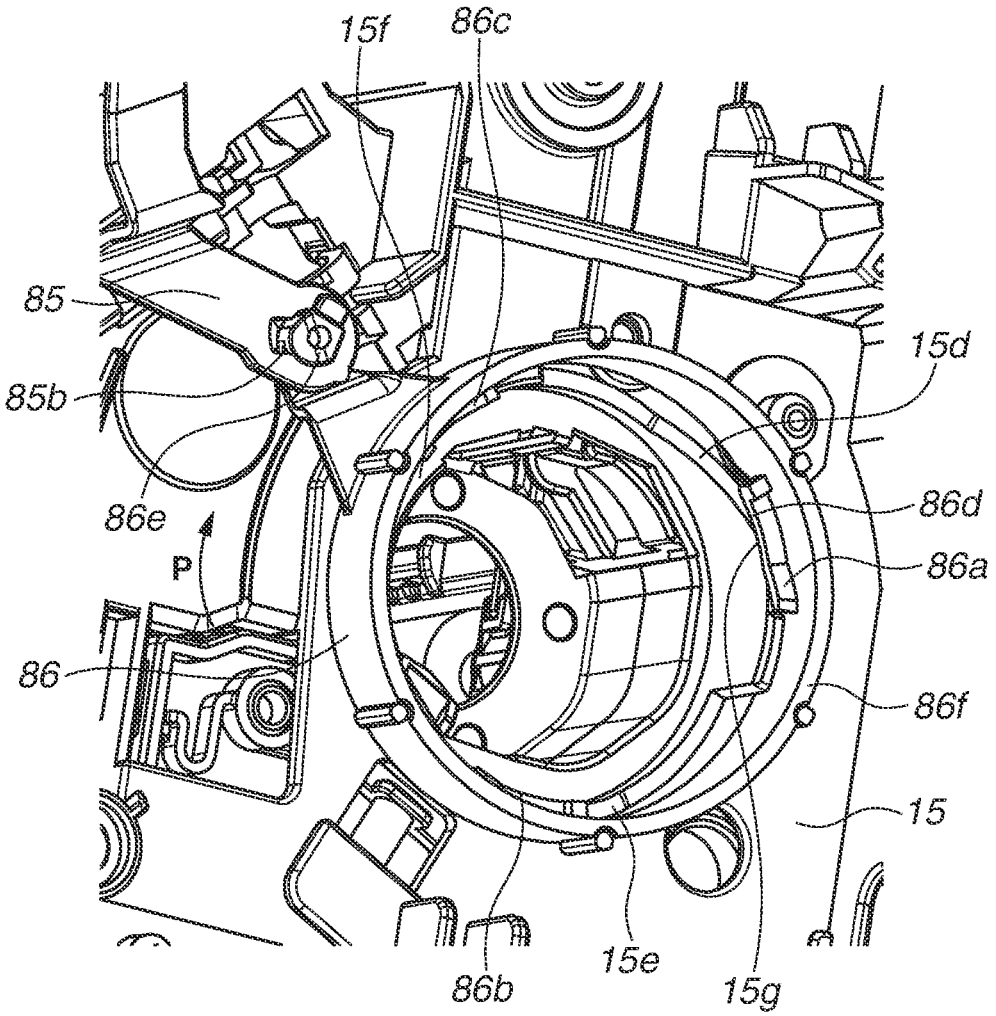
FIG. 5 is a perspective view illustrating a portion near a cylindrical cam in a state where the opening/closing door according to the first exemplary embodiment is open.

FIGS. 3A and 3B are perspective views respectively illustrating the image forming apparatus in a state where the opening/closing door 13 is open and closed. FIG. 3A is a perspective view illustrating the apparatus body A in a state where the opening/closing door 13 is open. FIG. 3B is a perspective view illustrating the apparatus body A in a state where the opening/closing door 13 is closed. FIG. 4 is a sectional view illustrating the drive transmission member 81 in a state where the opening/closing door 13 is closed. FIG. 5 is a perspective view illustrating a portion near a cylindrical cam 86 in a state where the opening/closing door 13 is open. In FIGS. 3A, 3B, and 5, the illustration of some components (including the drive transmission member 81) of the apparatus body A is omitted.

As illustrated in FIGS. 3A and 3B, the apparatus body A includes the opening/closing door 13, a cylindrical cam link 85, and the cylindrical cam 86. The opening/closing door 13 includes cartridge pressing members 1 and 2, which are provided on the driving side and the non-driving side, respectively. The cartridge pressing members 1 and 2 each include a pressing spring.

Further, the apparatus body A includes a first side plate 15 provided on the driving side, and a second side plate 16 provided on the non-driving side.

As illustrated in FIG. 4, the apparatus body A includes the drive transmission member 81 that engages with the cylindrical cam 86. The drive transmission member 81 is configured to transmit a driving force to the cartridge B. The cylindrical cam 86 is disposed so as to be located between the drive transmission member 81 and the first side plate 15. Further, the apparatus body A includes a bearing 94 that supports the drive transmission member 81. The driving side of the apparatus body A is provided with a support side plate 93, and the bearing 94 is mounted on the support side plate 93. The drive transmission member 81 includes a coupling concave portion 81*b* to be described below and the coupling concave portion 81*b* is exposed to the mounting portion Q.

The opening/closing door 13 is an opening/closing member for opening and closing the mounting portion Q for mounting the cartridge B (space for accommodating the cartridge). The opening/closing door 13 is rotatably mounted on the first side plate 15 and the second side plate 16. More specifically, the apparatus body A includes a mounting opening 17 for mounting the cartridge B on the mounting portion Q (see FIG. 1). The mounting opening 17 is configured to communicate with the mounting portion Q (see FIG. 1). The opening/closing door 13 is configured to cover the mounting opening 17 and the mounting portion Q in the state where the opening/closing door 13 is closed. In the case of mounting the cartridge B on the apparatus body A, the cartridge B is inserted to the mounting portion Q from the mounting opening 17 in the state where the opening/closing door 13 is open.

The cylindrical cam 86 is mounted on the first side plate 15 such that the cylindrical cam 86 is rotatable and movable in the longitudinal direction. The cylindrical cam 86 includes three slope portions 86*a*, 86*b*, and 86*c*. The first side plate 15 includes three slope portions 15*d*, 15*e*, and 15*f*, which are opposed to the three slope portions 86*a*, 86*b*, and 86*c*, respectively.

Further, in the longitudinal direction, one end portion 86*d*, which is adjacent to the slope portion 86*a*, is disposed on the non-driving side of the slope portion 86*a*. The first side plate 15 includes an end face 15*g* that is opposed to the one end portion 86*d*. In the present exemplary embodiment, the cylindrical cam 86 includes one end portion 86*d* that is adjacent to the slope portion 86*b*, and one end portion 86*d* that is adjacent to the slope portion 86*c*, like the one end portion 86*d* that is adjacent to the slope portion 86*a*. A plurality of end faces 15*g* is provided at a plurality of positions of the first side plate 15 so as to face the corresponding one end portion 86*d*.

As illustrated in FIG. 5, a boss 86*e* provided on the cylindrical cam 86 engages with a mounting hole 85*b* provided in the cylindrical cam link 85, so that the cylindrical cam 86 and the cylindrical cam link 85 are rotatably linked. As illustrated in FIGS. 3A and 3B, the other end portion of the cylindrical cam link 85 is rotatably linked to the opening/closing door 13.

When the opening/closing door 13 is opened, the cylindrical cam link 85 moves in conjunction with the opening/closing door 13, and the cylindrical cam 86 is rotated in a direction indicated by an arrow P (see FIG. 5). When the cylindrical cam 86 is rotated, the slope portions 86*a*, 86*b*, and 86*c* slide along the slope portions 15*d*, 15*e*, and 15*f*, respectively. Consequently, the cylindrical cam 86 is moved in a direction from the non-driving side toward the driving side (in a direction away from the mounting portion Q) in the longitudinal direction. In other words, the cylindrical cam 86 is moved in a direction away from the cartridge B in the longitudinal direction. The cylindrical cam 86 is moved to a position where the one end portion 86*d* of the cylindrical cam 86 abuts against the end face 15*g* of the first side plate 15.

As illustrated in FIG. 4, one end portion 81*c* of the drive transmission member 81 on the driving side in an axial direction (rotation axis direction) of the drive transmission member 81 is fitted to the bearing 94. With this configuration, the drive transmission member 81 is supported by the bearing 94 so that the drive transmission member 81 is rotatable and movable in the axial direction. Further, the drive transmission member 81 includes a contact surface 81*e*. The cylindrical cam 86 includes a contact portion 86*f* that is opposed to the contact surface 81*e*. There is a gap between the first side plate 15 and a central portion 81*d* of the drive transmission member 81 in the longitudinal direction. In the vicinity of this gap, an inclination member 97 including an inclining urging spring 98 for inclining the drive transmission member 81 is provided on the first side plate 15. The inclination member 97 will be described in detail below.

As described above, the cylindrical cam 86 is moved in the direction away from the cartridge B in the longitudinal direction. Thus, the contact surface 81*e* of the drive transmission member 81 is pressed against the contact portion 86*f* of the cylindrical cam 86, so that the drive transmission member 81 is moved in the direction away from the cartridge B in the longitudinal direction. In other words, the drive transmission member 81 is moved in the direction away from the mounting portion Q in the longitudinal direction. As a result, the drive transmission member 81 is in a retracted position.

As described above, the drive transmission member 81 is moved to the retracted position from a position where a driving force is transmitted to the cartridge B in conjunction with the movement of the opening/closing door 13 to the open position. When the drive transmission member 81 is located at the retracted position, the drive transmission member 81 is retracted from a path through which the cartridge B passes during mounting of the cartridge B. Consequently, the space for accommodating the cartridge B is secured in the apparatus body A.

In other words, each of the cylindrical cam 86 and the cylindrical cam link 85 is a retracting member (retracting mechanism) that moves the drive transmission member 81 to the retracted position in conjunction with the movement of the opening/closing door 13 to the open position.

When the opening/closing door 13 is closed, the slope portions 86*a*, 86*b*, and 86*c* of the cylindrical cam 86 are respectively rotated along the slope portions 15*d*, 15*e*, and 15*f* of the first side plate 15 through the cylindrical cam link 85. Then, the cylindrical cam 86 is moved to the non-driving side (side closer to the cartridge B) in the longitudinal direction. This movement enables the drive transmission member 81 located at the retracted position to be movable to the non-driving side (side closer to the cartridge B) in the longitudinal direction.

<Mounting of Cartridge>

Figure 6A:
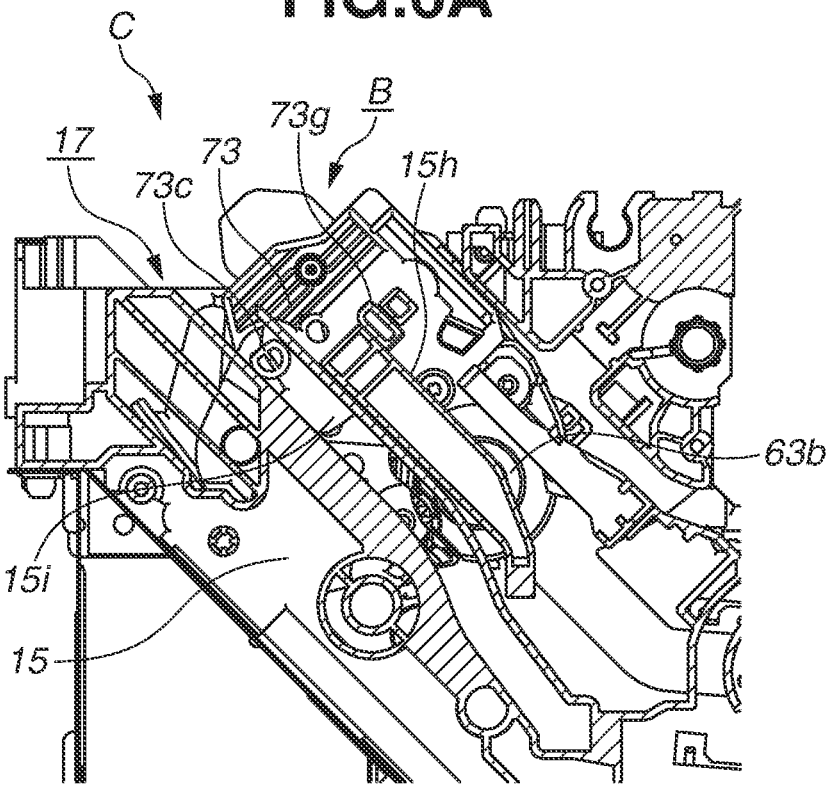
FIG. 6A is a sectional view illustrating the apparatus body as viewed from a driving side when the cartridge according to the first exemplary embodiment is mounted.
Figure 6B:
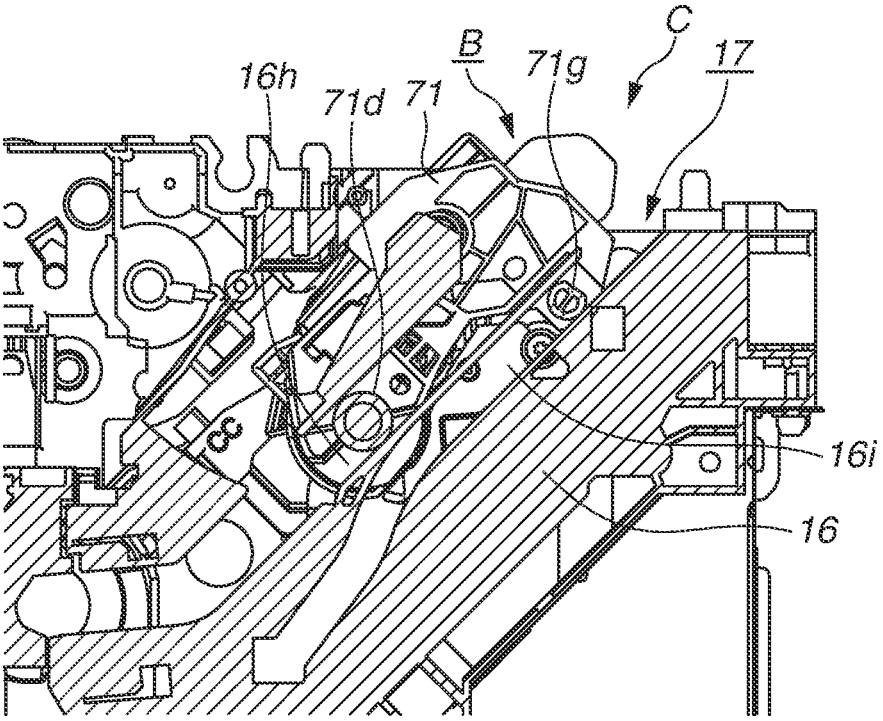
FIG. 6B is a sectional view illustrating the apparatus body as viewed from a non-driving side when the cartridge according to the first exemplary embodiment is mounted.

Next, mounting of the cartridge B will be described with reference to FIGS. 6A and 6B. FIGS. 6A and 6B are sectional views each illustrating the image forming apparatus when the cartridge B is mounted. FIG. 6A is a sectional view illustrating the apparatus body A as viewed from the driving side when the cartridge B is mounted. FIG. 6B is a sectional view illustrating the apparatus body A as viewed from the non-driving side when the cartridge B is mounted.

As illustrated in FIG. 6A, the first side plate 15 includes an upper guide rail 15*h* and a lower guide rail 15*i*. On the driving side of the cartridge B, a drum bearing 73 that supports a coupling convex portion 63*b* to be described below is provided. The drum bearing 73 is fixed to the drum frame 71 of the photosensitive member unit 60. The drum bearing 73 includes a guided portion 73*g* and a rotation stopped portion 73*c*. In a mounting direction (indicated by an arrow C) of the cartridge B, the guided portion 73*g* and the rotation stopped portion 73*c* are disposed on an upstream side of the axis of the coupling convex portion 63*b*.

As illustrated in FIG. 6B, the second side plate 16 includes an upper guide rail 16*h* and a lower guide rail 16*i*. On the non-driving side in the longitudinal direction, the cartridge B includes a positioned portion 71*d* and a rotation stopped portion 71*g*, which are provided in the drum frame 71.

The mounting direction C of the cartridge B is a direction crossing the rotation axis direction of the photosensitive drum 62 (perpendicular direction in the present exemplary embodiment). The upstream side and downstream side in the mounting direction C match the upstream side and downstream side in the movement direction of the cartridge B immediately before mounting of the cartridge B on the apparatus body A is completed.

When the cartridge B is mounted from the mounting opening 17 of the apparatus body A, the guided portion 73*g* and the rotation stopped portion 73*c* of the cartridge B are respectively guided by the upper guide rail 15*h* and the lower guide rail 15*i* of the apparatus body A on the driving side. On the non-driving side, the positioned portion 71*d* and the rotation stopped portion 71*g* of the cartridge B are respectively guided by the upper guide rail 16*h* and the guide rail 16*i* of the apparatus body A. As a result, the cartridge B is mounted on the apparatus body A.

<Drive Input Portion of Cartridge>

A drive input portion of the cartridge will be described with reference to FIGS. 4 and 7.

Figure 7:
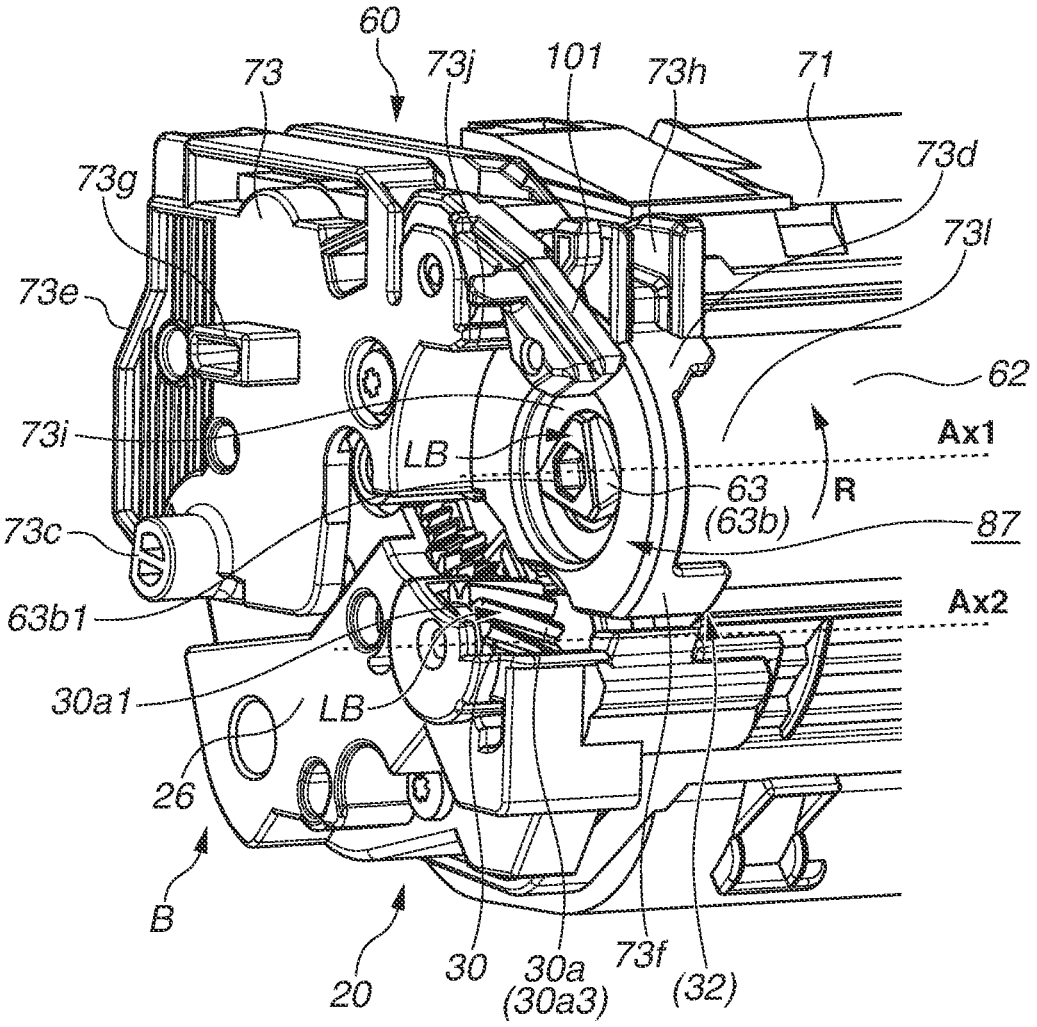
FIG. 7 is a perspective view illustrating the driving side of the cartridge according to the first exemplary embodiment.

FIG. 7 is a perspective view illustrating the driving side of the cartridge B. As illustrated in FIG. 7, a development roller gear (developing gear) 30 is provided at an end of the development roller 32. Specifically, the development roller gear 30 is coupled to a shaft portion (shaft) of the development roller 32.

The development roller 32 and the development roller gear 30 are coaxially provided and are rotated about an axis (rotation axis) Ax2 illustrated in FIG. 7. In the present exemplary embodiment, the axis Ax2 of the development roller 32 is disposed in parallel to an axis (rotation axis) Ax1 of the photosensitive drum 62. Accordingly, the axial direction of the development roller gear 30 is parallel to the axial direction of the photosensitive drum 62. The axis Ax2 of the development roller 32 is away from the axis Ax1 of the photosensitive drum 62 in a direction perpendicular to the axis Ax1 of the photosensitive drum 62.

The development roller gear 30 is a driving input gear (input gear, cartridge-side gear, drive input member) that receives a driving force (rotational force) from the outside of the cartridge B (i.e., from the apparatus body A). The development roller 32 is configured to be rotated by the driving force received by the development roller gear 30.

A driving-side drum flange (drum-side coupling, cartridge-side coupling, photosensitive-member-side coupling, input coupling) 63 is provided at an end of the photosensitive drum 62. The driving-side drum flange 63 is provided with the coupling convex portion 63*b*. The coupling convex portion 63*b* is a coupling portion (drum-side coupling portion, cartridge-side coupling portion, photosensitive-member-side coupling portion, input coupling portion, drive input portion) that receives a driving force (rotational force) from the outside of the cartridge B (i.e., from the apparatus body A). The coupling convex portion 63*b* is disposed coaxially with the photosensitive drum 62. In other words, the coupling convex portion 63*b* is rotated about the axis Ax1.

As illustrated in FIG. 7, the driving-side side surface of the cartridge B is provided with a space 87 for exposing the development roller gear 30 and the coupling convex portion 63*b* to the outside of the cartridge B. In a direction perpendicular to the axis Ax2, the space 87 is disposed on the side of the photosensitive drum 62 relative to the development roller gear 30.

In the longitudinal direction of the cartridge B (corresponding to the direction of the axis Ax1 and the direction of the axis Ax2), a side where the coupling convex portion 63*b* is provided corresponds to the driving side, and a side opposite to the driving side corresponds to the non-driving side.

As illustrated in FIG. 7, the development roller gear 30 includes an input gear portion (input gear portion, cartridge-side gear portion, development-side gear portion) 30*a* and an end face 30*a* provided on the driving side of the gear portion. Teeth (gear teeth) formed on the outer periphery of the input gear portion 30*a* are helical teeth inclined with respect to the axis of the development roller gear 30. In other words, the development roller gear 30 is a helical gear.

The "helical teeth" described herein also include a tooth having a shape in which a plurality of projections is arranged along a line inclined with respect to the axis of the gear to substantially form a helical tooth portion.

As illustrated in FIG. 4, the drive transmission member (drive output member, main-body-side drive member) 81 includes an output gear portion (main-body-side gear portion, output gear portion, output gear) 81*a* for driving the development roller gear 30. The output gear portion 81*a* includes an end face 81*a*1 at an end on the non-driving-side. Teeth (gear teeth) formed on the output gear portion 81*a* are also helical teeth inclined with respect to the axis of the drive transmission member 81. In other words, the drive transmission member 81 is also provided with a helical gear portion. The output gear portion 81*a* is configured to engage with the development roller gear 30.

Further, the drive transmission member 81 includes the coupling concave portion 81*b* that engages with the coupling convex portion 63*b*. The coupling concave portion 81*b* is a coupling portion (main-body-side coupling portion, output coupling portion) that is provided in the apparatus body A. The coupling concave portion 81*b* has a configuration in which a concave portion that engages with the coupling convex portion 63*b* provided on the photosensitive drum 62 is formed on a coupling cylindrical portion 81*i* which is provided at a leading end of the drive transmission member 81. The output gear portion 81*a* and the coupling concave portion 81*b* are coaxially arranged. Specifically, the output gear portion 81*a* and the coupling concave portion 81*b* are configured to be rotatable about one rotation axis (first axis). In a state where the output gear portion 81*a* is engaged with the development roller gear 30 and the coupling concave portion 81*b* is engaged with the coupling convex portion 63*b*, these components are rotated about the axis Ax1 of the photosensitive drum 62. In the present exemplary embodiment, the output gear portion 81*a* and the coupling concave portion 81*b* are integrally formed.

In the space 87 that is configured to expose the input gear portion 30*a* and the coupling convex portion 63*b*, the output gear portion 81*a* of the drive transmission member 81 is disposed when the cartridge B is mounted on the apparatus body A. Accordingly, the space 87 is larger than the output gear portion 81*a* of the drive transmission member 81. The presence of the space 87 prevents the drive transmission member 81 from interfering with the cartridge B when the cartridge B is mounted on the apparatus body A. The drive transmission member 81 is disposed in the space 87, thereby allowing mounting of the cartridge B on the apparatus body A.

When the cartridge B is viewed along the axis Ax1 of the photosensitive drum 62 (the axis of the coupling convex portion 63*b*), the gear teeth formed on the input gear portion 30*a* are disposed at a position close to the peripheral surface of the photosensitive drum 62. The gear teeth of the input gear portion 30*a* include an exposed portion 30*a*3 that is exposed from the cartridge B. More specifically, the development unit 20 includes a driving-side cover 26 and a part of the input gear portion 30*a* is exposed from the driving-side cover 26. Since the input gear portion 30*a* of the development roller gear 30 is exposed from the driving-side cover 26, the output gear portion 81*a* engages with the input gear portion 30*a* without interfering with the driving-side cover 26, thereby enabling transmission of a driving force.

As illustrated in FIG. 7, at least a part of the exposed portion 30*a*3 of the input gear portion 30*a* is disposed on the outside of a leading end 63*b* of the coupling convex portion 63*b* in the longitudinal direction of the cartridge B. The exposed portion 30*a*3 faces the axis Ax1 (or an extension of the axis Ax1) of the photosensitive drum 62. In other words, the exposed portion 30*a*3 faces the axis of the coupling convex portion 63*b* (or an extension of the axis of the coupling convex portion 63*b*). In the present exemplary embodiment, the axis Ax1 of the photosensitive drum 62 is located above the exposed portion 30*a*3 of the input gear portion 30*a* in a state where the cartridge B is mounted on the mounting portion Q.

As illustrated in FIG. 7, at least a part of the input gear portion 30*a* projects toward the driving side (outside) relative to the coupling convex portion 63*b* in the direction of the axis Ax1. The input gear portion 30*a* is disposed to overlap the output gear portion 81*a* of the drive transmission member 81 in the direction of the axis Ax1. A part of the input gear portion 30*a* is exposed to face the axis Ax1 of the photosensitive drum 62, so that the input gear portion 30*a* and the output gear portion 81*a* of the drive transmission member 81 can contact each other in the process of inserting the cartridge B into the apparatus body A.

The above-described positional relationship enables meshing of the input gear portion 30*a* of the development roller gear 30 and the output gear portion 81*a* of the drive transmission member 81 in the process of mounting the cartridge B on the apparatus body A.

In the mounting direction C of the cartridge B, the center (axis Ax2) of the input gear portion 30*a* is disposed on the upstream side of the center (axis Ax1) of the photosensitive drum 62.

The drum bearing 73 includes a fitted portion 73*h* serving as a positioned portion (axially positioned portion) in the longitudinal direction of the cartridge B. The first side plate 15 of the apparatus body A includes a fitting portion 15*j* (see FIGS. 17A and 17B) that can be fitted to the fitted portion 73*h*. The fitted portion 73*h* of the cartridge B is fitted to the fitting portion 15*j* of the apparatus body A in the process of mounting the cartridge B on the mounting portion Q. Consequently, the position of the cartridge B in the longitudinal direction is determined. In the present exemplary embodiment, the fitted portion 73*h* is a slit (groove).

<Operation for Closing Opening/closing Door>

Next, the state where the opening/closing door 13 is closed will be described with reference to FIGS. 8A and 8B.

Figure 8A:
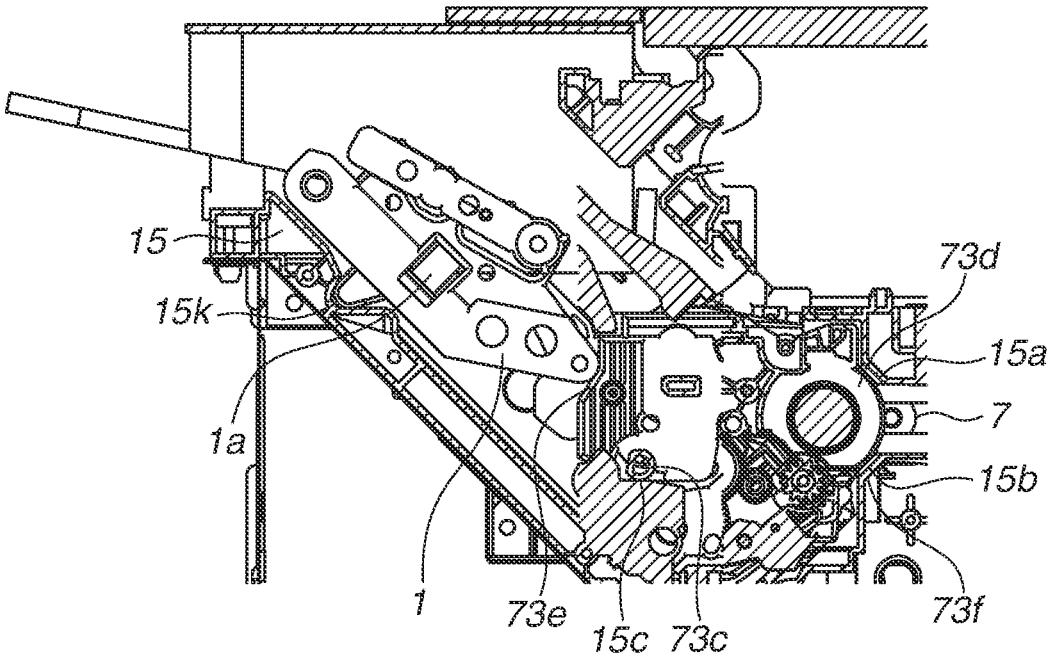
FIG. 8A is a sectional view illustrating a cartridge pressing portion and a positioning portion on the driving side according to the first exemplary embodiment.
Figure 8B:
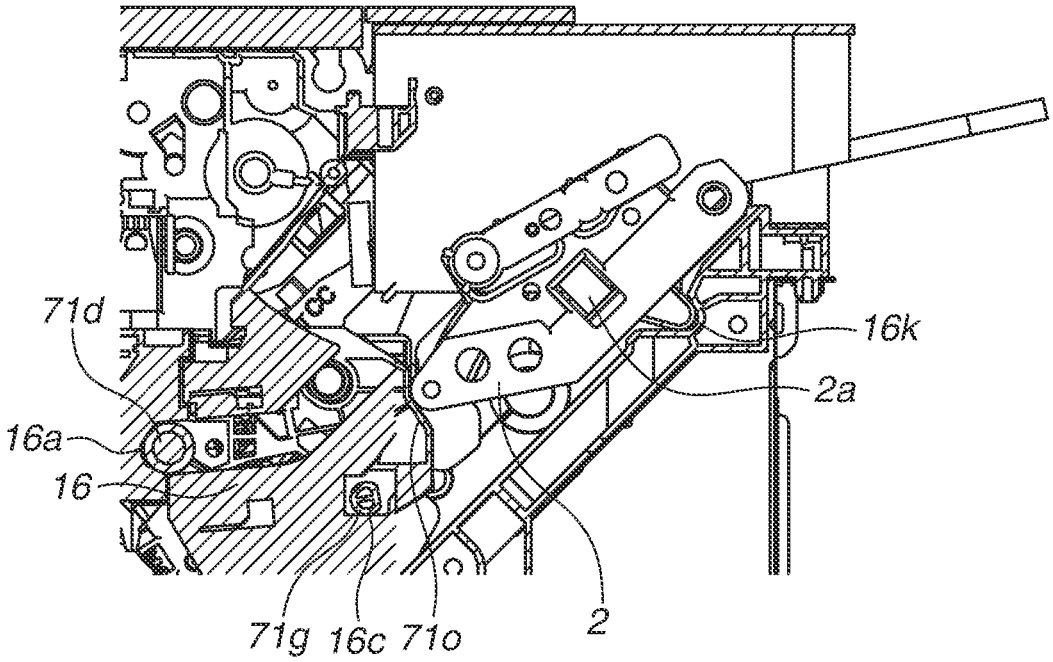
FIG. 8B is a sectional view illustrating the cartridge pressing portion and the positioning portion on the non-driving side according to the first exemplary embodiment.

FIGS. 8A and 8B are sectional views each illustrating a cartridge pressing portion and a positioning portion of the image forming apparatus. FIG. 8A is a sectional view illustrating the cartridge pressing portion and the positioning portion on the driving side. FIG. 8B is a sectional view illustrating the cartridge pressing portion and the positioning portion on the non-driving side.

As illustrated in FIG. 8A, on the driving side, the first side plate 15 includes an upper positioning portion 15*a* and a lower positioning portion 15*b* as positioning portions, and a rotation stopping portion 15*c*. The drum bearing 73 includes an upper positioned portion (first positioned portion, first projection, first projecting portion) 73*d* and a lower positioned portion (second positioned portion, second projection, second projecting portion) 73*f*. Further, the drum bearing 73 includes a pressed portion 73*e* as a cartridge-side urging force receiving portion. The first side plate 15 includes a pressed portion 15*k* as an apparatus-body-side urging force receiving portion.

As illustrated in FIG. 8B, on the non-driving side, the second side plate 16 includes a positioning portion 16*a* and a rotation stopping portion 16*c*. The cartridge B includes the positioned portion 71*d* and the rotation stopped portion 71*g*. Further, the cartridge B includes a pressed portion 71*o* as a cartridge-side urging force receiving portion. The second side plate 16 includes a pressed portion 16*k* as an apparatus-body-side urging force receiving portion.

As illustrated in FIGS. 8A and 8B, the apparatus body A includes the cartridge pressing members 1 and 2. The cartridge pressing members 1 and 2 are slidably mounted on both ends, respectively, in the axial direction of the opening/closing door 13. Cartridge pressing springs 1*a* and 2*a* are attached to the cartridge pressing members 1 and 2, respectively.

When the opening/closing door 13 is closed, the pressed portion 73*e* of the cartridge B and the pressed portion 15*k* of the apparatus body A are pressed by the cartridge pressing member 1 urged by the cartridge pressing spring 1*a* on the driving side. On the non-driving side, the pressed portion 71*o* of the cartridge B and the pressed portion 16*k* of the apparatus body A are pressed by the cartridge pressing member 2 urged by the cartridge pressing spring 2*a*.

With this configuration, on the driving side, the upper positioned portion 73*d*, the lower positioned portion 73*f*, and the rotation stopped portion 73*c* respectively contact the upper positioning portion 15*a*, the lower positioning portion 15*b*, and the rotation stopping portion 15*c* of the apparatus body A. As a result, the cartridge B and the photosensitive drum 62 are positioned on the driving side. On the non-driving side, the positioned portion 71*d* and the rotation stopped portion 71*g* of the cartridge B respectively contact the positioning portion 16*a* and the rotation stopping portion 16*c* of the apparatus body A. As a result, the cartridge B and the photosensitive drum 62 are positioned on the non-driving side.

As described above, the pressed portions 73*e* and 71*o* are respectively disposed on one end side (driving side) and the other end side (non-driving side) of the cartridge B in the longitudinal direction of the cartridge B. In particular, the pressed portion 73*e* is provided on the drum bearing 73. The pressed portions 73*e* and 71*o* each have a concave shape (V-shape) for positioning the cartridge pressing members 1 and 2, and the cartridge pressing members 1 and 2 are positioned by the pressed portions 73*e* and 71*o*, respectively.

<Space for Exposing Development Roller Gear and Coupling Convex Portion>

Next, the space 87 in which the drive transmission member 81 is disposed and through which the development roller gear 30 and the coupling convex portion 63*b* are exposed to the outside of the cartridge B will be described with reference to FIG. 7.

As illustrated in FIG. 7, the upper positioned portion 73*d* and the lower positioned portion 73*f* are disposed near the photosensitive drum 62. The upper positioned portion 73*d* and the lower positioned portion 73*f* are arranged along the rotational direction of the photosensitive drum 62. In the drum bearing 73, a transfer space (circular-arc-shaped recess) 731 that allows the transfer roller 7 to contact the photosensitive drum 62 may be secured between the upper positioned portion 73*d* and the lower positioned portion 73*f*. Accordingly, the upper positioned portion 73*d* and the lower positioned portion 73*f* are disposed at positions away from each other. The upper positioned portion 73*d* and the lower positioned portion 73*f* are projections that project toward the inside of the cartridge B in the direction of the axis Ax1 from the drum bearing 73. As described above, the space 87 may be secured around the coupling convex portion 63*b*. Accordingly, the space 87 is secured by allowing the upper positioned portion 73*d* and the lower positioned portion 73*f* to project toward the inside of the cartridge B, instead of allowing the upper positioned portion 73*d* and the lower positioned portion 73*f* to project toward the outside of the cartridge B.

Further, the upper positioned portion 73*d* and the lower positioned portion 73*f* are disposed to cover a part of the driving-side drum flange 63 provided at an end of the photosensitive drum 62. Specifically, when the upper positioned portion 73*d* and the driving-side drum flange 63 are projected in a direction perpendicular to the axis Ax1 of the photosensitive drum 62, projection areas of the upper positioned portion 73*d* and the driving-side drum flange 63 partially overlap each other. This configuration is similar to that of the lower positioned portion 73*f* and the upper positioned portion 73*d*.

As described above, when the opening/closing door 13 is closed, the cylindrical cam 81 is rotated and thus is movable to the non-driving side (side closer to the cartridge B) in the longitudinal direction. Further, the drive transmission member 81 located at the retracted position is movable to the non-driving side (side closer to the cartridge B) in the longitudinal direction.

<Driving Start Operation of Drive Transmission Member>

Next, a driving start operation of the drive transmission member 81 after the opening/closing door 13 is closed will be described with reference to FIGS. 7, 9, and 10.

Figure 9:
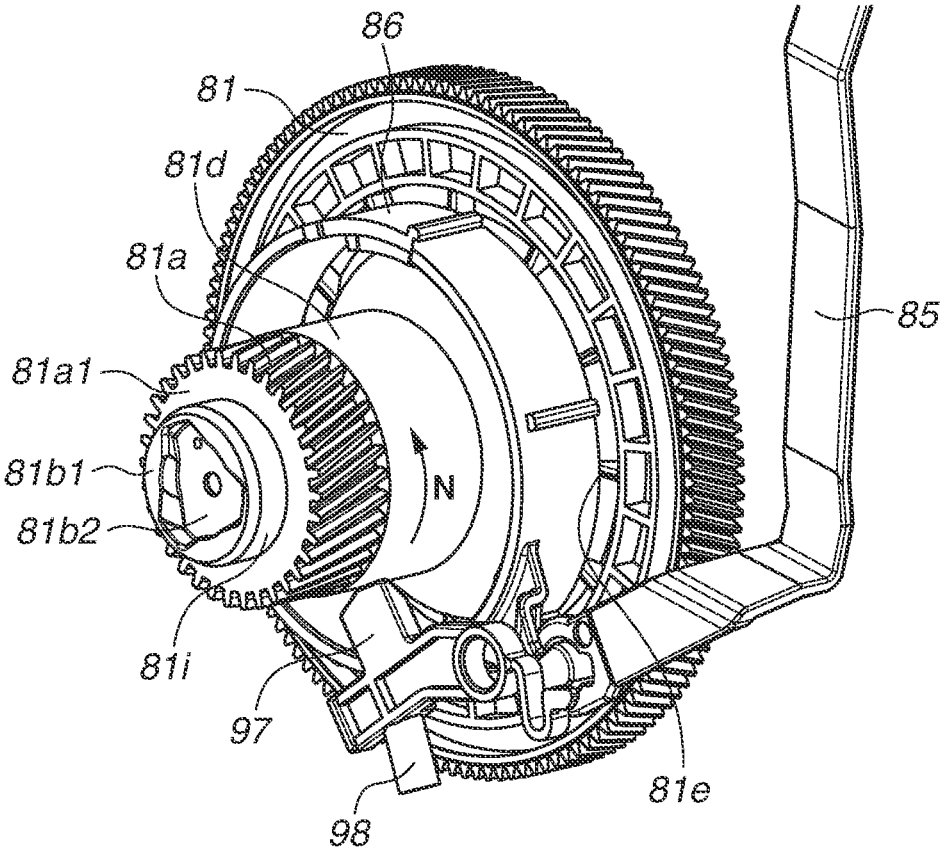
FIG. 9 is a perspective view illustrating the drive transmission member according to the first exemplary embodiment.

FIG. 9 is a perspective view illustrating the drive transmission member 81. FIG. 10 is a sectional view illustrating an operation in a thrust direction of the drive transmission member 81 when the coupling convex portion 63*b* and the coupling concave portion 81*b* engage with each other.

As illustrated in FIG. 9, the drive transmission member 81 includes the coupling concave portion 81*b* and a leading end 81*b*1 of the coupling concave portion 81*b*. The coupling concave portion 81*b* includes a bottom portion 81*b*2 as an axially positioning portion. In the present exemplary embodiment, the coupling concave portion 81*b* of the drive transmission member 81 is a hole having a substantially triangular sectional shape. The coupling concave portion 81*b* has a shape that is twisted in a counterclockwise direction N toward the driving side (back side of the concave portion 81*b*) from the non-driving side (cartridge side, opening side of the concave portion 81*b*). The output gear portion 81*a* of the drive transmission member 81 is a helical gear and includes gear teeth that are twisted in the counterclockwise direction N toward the driving side from the non-driving side (cartridge side).

The output gear portion 81*a* and the coupling concave portion 81*b* are disposed such that the axis of the output gear portion 81*a* and the axis of the coupling concave portion 81*b* overlap the axis of the drive transmission member 81. In other words, the output gear portion 81*a* and the coupling concave portion 81*b* are coaxially (concentrically) disposed. That is, as described above, the output gear portion 81*a* and the coupling concave portion 81*b* are configured to be rotatable about one rotation axis (first axis). In a state where output gear portion 81*a* is engaged with the development roller gear 30 and the coupling concave portion 8*b* is engaged with the coupling convex portion 63*b*, these components are rotated about the axis Ax1 of the photosensitive drum 62.

As illustrated in FIG. 7, the drum bearing 73 includes a concave bottom surface 73*i* formed in the vicinity of the coupling convex portion 63*b*. The driving-side drum flange 63 includes the coupling convex portion 63*b* and the leading end 63*b*1 located at the leading end of the coupling convex portion 63*b*. The coupling convex portion 63*b* of the driving-side drum flange 63 has a substantially triangular sectional shape and has a convex shape (convex portion, projection). The coupling convex portion 63*b* has a shape that is twisted in the counterclockwise direction N toward the non-driving side (bottom side of the coupling convex portion 63*b*) from the driving side (leading end side of the coupling convex portion 63*b*). In other words, in the direction of the axis Ax1, the coupling convex portion 63*b* is twisted in the drum rotational direction R toward the inside of the cartridge B from the outside of the cartridge B.

The coupling convex portion 63*b* is a driving force receiving portion that receives a driving force from the coupling concave portion 81*b*. The coupling concave portion 81*b* is a driving force supplying portion for supplying a driving force to the coupling convex portion 63*b*. More specifically, in the coupling convex portion 63*b*, a portion (ridge line) forming a corner of a triangular prism (an apex of a triangle) corresponds to a portion that receives the driving force (rotational force) from the coupling concave portion 81*b*.

The shape of a cross section of each of the coupling convex portion 63*b* and the coupling concave portion 81*b* is not the exact triangle (polygon) in that corners are rounded, but the shape will be referred to as a substantial triangle (polygon). In other words, the coupling convex portion 63*b* has a shape in which a projection of a substantially triangular prism (square prism) is twisted. However, the shape of the coupling convex portion 63*b* is not limited to this example. The shape of the coupling convex portion 63*b* may be changed as long as the coupling convex portion 63*b* can engage with the coupling concave portion 81*b* to receive a driving force. For example, the coupling convex portion 63*b* may have such a shape that a non-circular projection is twisted. Further, in the coupling convex portion 63*b*, three projections may be disposed at the respective apexes of triangles and the projections may have a shape that is twisted about the axis of the photosensitive drum 62.

As illustrated in FIG. 7, the input gear portion 30*a* of the development roller gear 30 is a helical gear and has a shape that is twisted (inclined) in a clockwise direction toward the non-driving side from the driving side. Specifically, in the axial direction of the input gear portion 30*a*, the gear teeth of the input gear portion 30*a* are inclined (twisted) in the clockwise direction (rotational direction of the development roller and the development roller gear) toward the inside of the cartridge B from the outside of the cartridge B. In other words, the input gear portion 30*a* is inclined (twisted) in the direction opposite to the rotational direction R of the photosensitive drum 62 toward the inside from the outside in the axial direction.

The drive transmission member 81 is rotated by a motor (not illustrated) of the apparatus body A. The drive transmission member 81 is rotated in the clockwise direction (rotational direction of the photosensitive drum 62) as viewed from the non-driving side (cartridge side).

Figure 10:
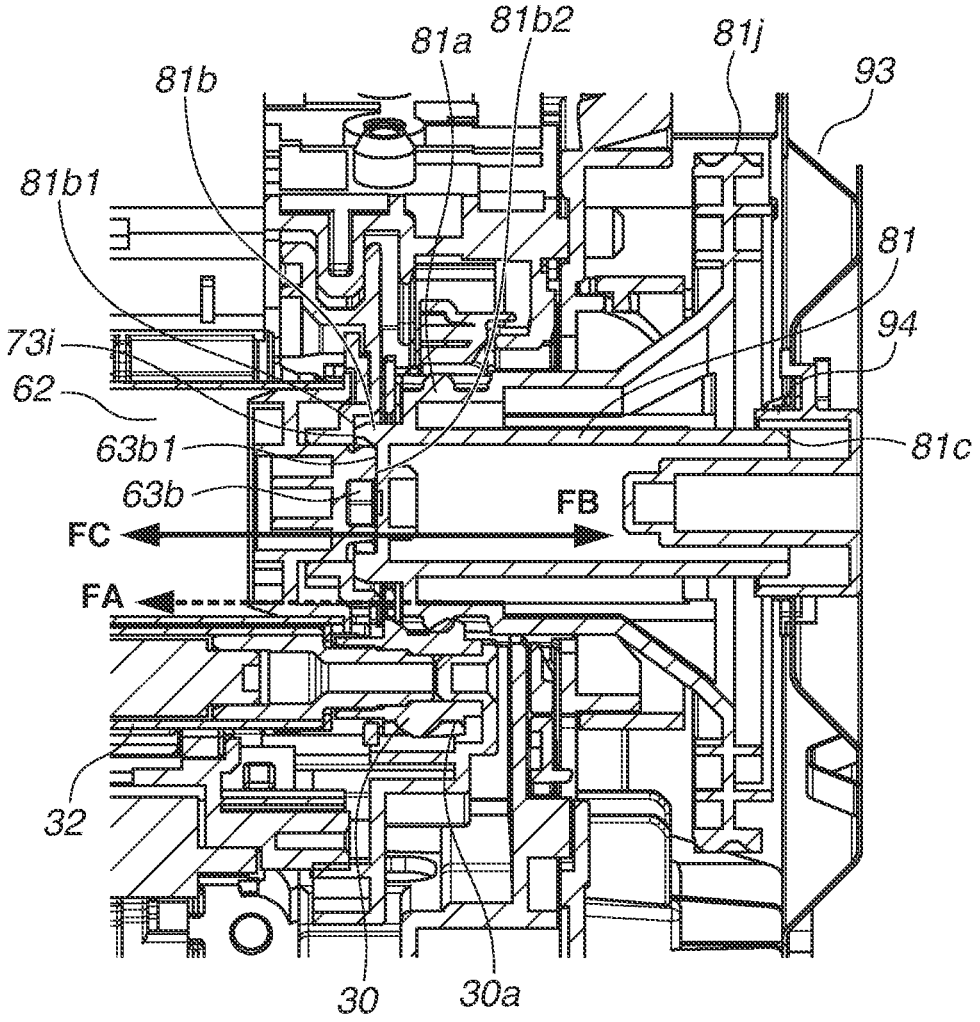
FIG. 10 is a sectional view illustrating an operation of the drive transmission member in a thrust direction when a coupling convex portion and a coupling concave portion according to the first exemplary embodiment engage with each other.

As illustrated in FIG. 10, a thrust force (force generated in the axial direction of the gear) is generated by meshing of the helical teeth of the output gear portion 81*a* of the drive transmission member 81 with the input gear portion 30*a* of the development roller gear 30. A force FA generated in the axial direction (longitudinal direction) acts on the drive transmission member 81, and the drive transmission member 81 is moved to the non-drive side (side closer to the cartridge B) in the longitudinal direction. That is, the drive transmission member 81 approaches and contacts the coupling convex portion 63*b*.

Then, when the triangular phase of the coupling concave portion 81*b* matches the triangular phase of the coupling convex portion 63*b* by the rotation of the drive transmission member 81, the coupling convex portion 63*b* and the coupling concave portion 81*b* engage with each other.

When the coupling convex portion 63*b* and the coupling concave portion 81*b* engage with each other, the coupling concave portion 81*b* and the coupling convex portion 63*b* are twisted (inclined) with respect to the axis, so that a new thrust force FC is generated.

Specifically, the force FC directed toward the non-driving side (side closer to the cartridge B) in the longitudinal direction acts on the drive transmission member 81. This force FC combined with the above-described force FA causes the drive transmission member 81 to further move toward the non-driving side (side closer to the cartridge) in the longitudinal direction. That is, the coupling convex portion 63*b* has a function for causing the drive transmission member 81 to approach the coupling convex portion 63*b*.

The drive transmission member 81 attracted by the coupling convex portion 63*b* is positioned in the longitudinal direction (axial direction) by the leading end 81*b*1 of the drive transmission member 81 contacting the concave bottom surface 73*i* of the drum bearing 73.

A reaction force FB of the force FC acts on the photosensitive drum 62. This reaction force FB causes the photosensitive drum 62 to move toward the driving side (side closer to the drive transmission member 81, outside of the cartridge B) in the longitudinal direction. In other words, the photosensitive drum 62 and the coupling convex portion 63*b* are attracted by the drive transmission member 81. This enables the leading end 63*b*1 of the coupling convex portion 63*b* to contact the bottom portion 81*b*2 of the coupling concave portion 81*b*. As a result, the photosensitive drum 62 is also positioned in the axial direction (longitudinal direction).

That is, the coupling convex portion 63*b* and the coupling concave portion 81*b* are attracted to each other, so that the positions of the photosensitive drum 62 and the drive transmission member 81 in the longitudinal direction (direction of the axis Ax1) are determined.

In this state, the drive transmission member 81 is in a driving position (advanced position). In other words, the drive transmission member 81 is in a position for transmitting a driving force to each of the coupling convex portion 63*b* and the input gear portion 30*a*, and is in a position advanced toward the cartridge B.

This advanced position is also referred to as an engagement position where the coupling concave portion 81*b* engages with the coupling convex portion 63*b*. That is, the drive transmission member 81 is configured such that the coupling concave portion 81*b* is movable between the engagement position and a position (retracted position) away from the coupling convex portion 63*b*.

In the present exemplary embodiment, in the case of mounting the cartridge B on the mounting portion Q, the opening/closing door 13 is temporarily opened, and thus the drive transmission member 81 is located at the retracted position. Then, when the cartridge B is mounted and the opening/closing door 13 is closed, the drive transmission member 81 is in the state of being movable in the direction closer to the cartridge B while being located at the retracted position. In this case, in a state where the drive transmission member 81 is located at the retracted position, the output gear portion 81*a* is engaged with the input gear portion 30*a*. The drive transmission member 81 is moved from the retracted position to the engagement position where the coupling concave portion 81*b* engages with the coupling convex portion 63*b* by a force (thrust force) generated when the output gear portion 81*a* drives the input gear portion 30*a*.

Due to the alignment action of the triangular shape of the coupling concave portion 81*b*, the rotation axis of the drive transmission member 81 matches the rotation axis of the driving-side drum flange 63. Specifically, the drive transmission member 81 is aligned with the drum flange 63, so that the drive transmission member 81 and the photosensitive drum 62 are disposed coaxially. With this configuration, the driving force can be accurately transmitted from the drive transmission member 81 to the development roller gear 30 and the driving-side drum flange 63.

In other words, each of the coupling concave portion 81*b* and the coupling convex portion 63*b* functions as an alignment portion. Specifically, the coupling concave portion 81*b* and the coupling convex portion 63*b* engage with each other, so that the drive transmission member 81 and the photosensitive drum 62 are disposed coaxially. The coupling concave portion 81*b* can be referred to as a main-body-side alignment portion, and the coupling convex portion 63*b* can be referred to as a cartridge-side alignment portion.

As described above, the force FA and force FC which act on the drive transmission member 81 and are directed toward the non-driving side assist the coupling engagement.

In the longitudinal direction, the drive transmission member 81 is positioned by the drum bearing (bearing member) 73 provided in the cartridge B, thereby enhancing the positioning accuracy of the drive transmission member 81 with respect to the cartridge B. Thus, the positioning accuracy of the output gear portion 81*a* with respect to the input gear portion 30*a* of the development roller gear 30 is enhanced. This leads to a reduction in the width of the input gear portion 31*a* of the development roller gear 30 in the longitudinal direction of the cartridge B. Consequently, the cartridge B and the apparatus body A on which the cartridge B is mounted can be made compact.

Each of the output gear portion 81*a* of the drive transmission member 81 and the input gear portion 30*a* of the development roller gear 30 is a helical gear. The contact ratio of the gears is higher with the helical gears than with spur gears. As a result, the accuracy of rotation of the development roller 32 is enhanced and the development roller 32 can be smoothly rotated.

A direction in which the helical teeth of the input gear portion 30*a* and the output gear portion 81*a* are inclined is set so as to generate a force for causing the input gear portion 30*a* and the output gear portion 81*a* to attract each other (force FA and force FB). Specifically, when the input gear portion 30*a* and the output gear portion 81*a* are rotated in a state where the input gear portion 30*a* and the output gear portion 81*a* engage with each other, a force for bringing the coupling concave portion 81*b* provided on the drive transmission member 81 and the coupling convex portion 63*b* provided at an end of the photosensitive drum 62 close to each other is generated. As a result, the drive transmission member 81 moves toward the cartridge B and the coupling concave portion 81*b* also approaches the coupling convex portion 63*b*. This configuration assists the engagement between the coupling concave portion 81*b* and the coupling convex portion 63*b*.

<Conditions for Coupling Engagement>

Figure 11:
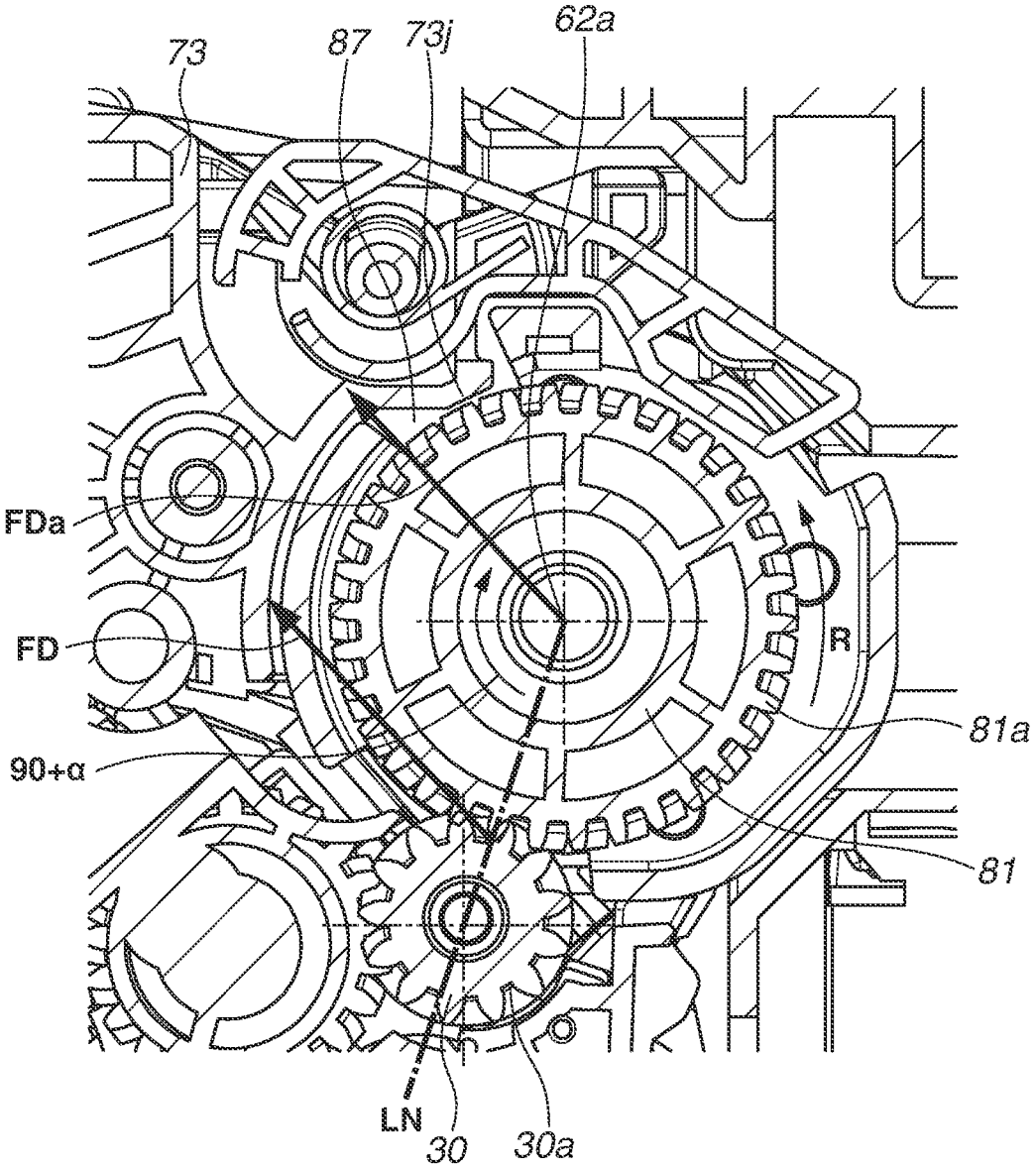
FIG. 11 is a sectional view illustrating the image forming apparatus according to the first exemplary embodiment as viewed from the driving side.

Next, conditions for coupling engagement will be described with reference to FIGS. 7 and 11. FIG. 11 is a sectional view illustrating the image forming apparatus as viewed from the driving side.

As illustrated in FIGS. 7 and 11, the drum bearing 73 includes a regulation portion (first regulation portion) 73*j* as an inclination regulation portion (movement regulation portion, position regulation portion, stopper) for regulating the movement of the drive transmission member 81, to thereby regulate (limit) the inclination of the drive transmission member 81.

As described above, the output gear portion 81*a* of the drive transmission member 81 and the input gear portion 30*a* of the development roller gear 30 mesh with each other when the drive transmission member 81 starts to rotate in the rotational direction R of the photosensitive drum 62. In other words, the output gear portion 81*a* drives the input gear portion 30*a* in the state where the drive transmission member 81 is located at the retracted position. On the other hand, the coupling concave portion 81*b* and the coupling convex portion 63*b* are not engaged with each other, or the engagement therebetween is insufficient. If the output gear portion 81*a* transmits a driving force to the input gear portion 30*a* in this state, a meshing force FD is generated in the outer gear portion 81*a* due to meshing of the gears.

When the meshing force FD acts on the drive transmission member 81, the drive transmission member 81 tends to move in the direction perpendicular to the rotation axis of the drive transmission member 81. As described above, only the one end portion 81*c* (end on a side farther from the cartridge B) of the drive transmission member 81 is supported by the bearing 94. Accordingly, the drive transmission member 81 is inclined with the driving-side one end portion 81*c* as a fulcrum. Then, an end (free end, leading end) on the side where the coupling concave portion 81*b* of the drive transmission member 81 is provided moves. In other words, the coupling concave portion 81*b* of the drive transmission member 81 tends to move in a direction away from the axis Ax1 in the direction perpendicular to the axis Ax1 of the photosensitive drum 62.

If the drive transmission member 81 is greatly inclined, the coupling concave portion 81*b* cannot engage with the coupling convex portion 63*b*. To avoid this, the regulation portion 73*j* is provided in the cartridge B to thereby restrict (regulate) the inclination of the drive transmission member 81 within a certain range. Specifically, when the drive transmission member 81 is inclined, the regulation portion 73*j* supports the drive transmission member 81 to thereby suppress an increase in the inclination. In other words, the regulation portion 73*j* is configured to regulate the movement of the drive transmission member 81 in the direction perpendicular to the rotation axis of the drive transmission member 81. That is, the regulation portion 73*j* is disposed at a position where the drive transmission member 81 can be prevented from being moved (inclined) by the meshing force FD.

In the present exemplary embodiment, the regulation portion 73*j* of the drum bearing 73 is an arcuate curved surface portion disposed to face the axis of the photosensitive drum 62 (axis of the coupling convex portion 63*b*, or an extension of the axis). The regulation portion 73*j* can also be referred to as a projecting portion that projects to cover the axis Ax1 of the photosensitive drum 62. The space 87 in which the components of the process cartridge B are not disposed is formed between the regulation portion 73*j* and the axis Ax1 of the photosensitive drum 62. In other words, the regulation portion 73*j* faces the space 87 and the regulation portion 73*j* forms an edge (outer edge) of the space 87.

As illustrated in FIG. 11, the direction in which the meshing force FD is generated is determined by a transverse pressure angle $\alpha$ of the output gear portion 81*a* (i.e., the transverse pressure angle $\alpha$ of the development roller gear 30). The direction of the meshing force FD is a direction (indicated by an arrow FDa) in which an angle of $(90+\alpha)$ degrees is formed toward the upstream side of the rotational direction R of the photosensitive drum 62 with respect to a straight line LN extending from a center 62*a* of the photosensitive drum 62 (center of the drive transmission member 81) to a center 30*b* of the development roller gear 30. The regulation portion 73*j* need not necessarily be disposed to overlap the direction indicated by the arrow FDa, and the regulation portion 73*j* may be disposed near the direction indicated by the arrow FDa.

Further, the regulation portion 73*j* may be disposed on the upstream side in the cartridge mounting direction C with respect to the center (axis) of the coupling convex portion 63*b* so as to prevent the regulation portion 73*j* from interfering with mounting of the cartridge B.

<Inclination Configuration of Drive Transmission Member>

Next, an inclination configuration of the drive transmission member will be described with reference to FIGS. 10, 12, 13A, 13B, and 14.

Figure 12:
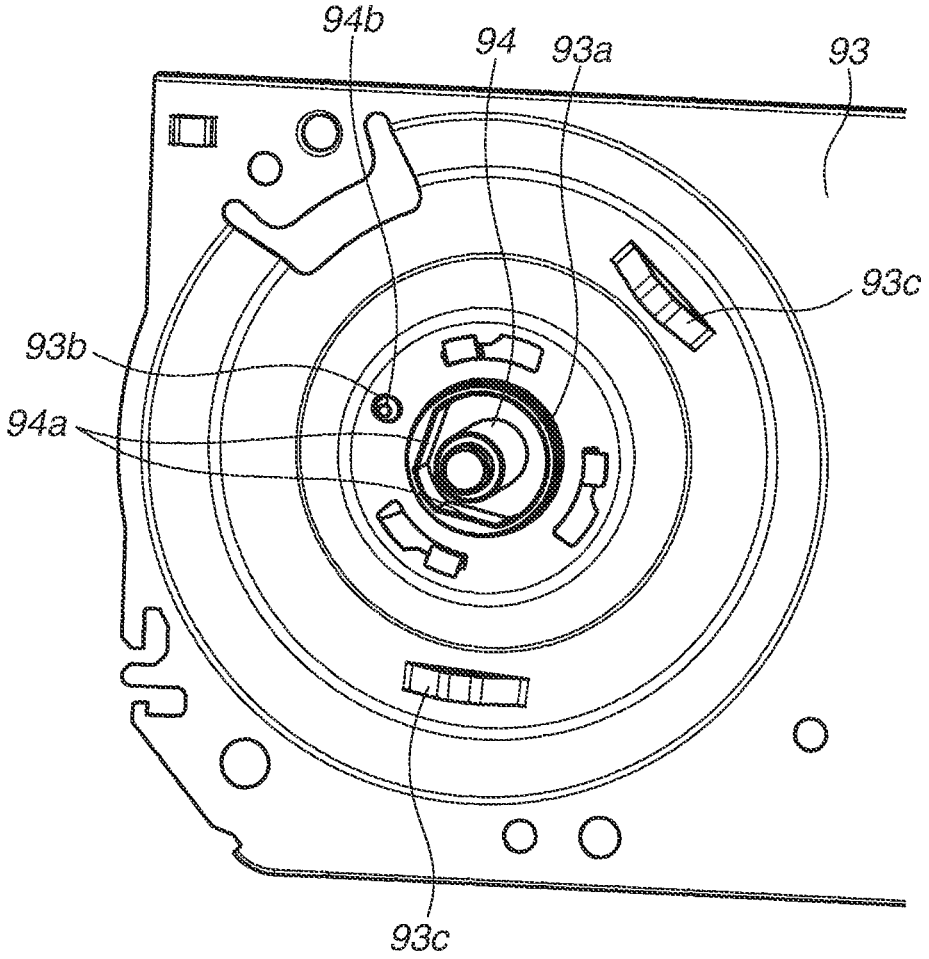
FIG. 12 is a perspective view illustrating a configuration of a bearing that supports the drive transmission member according to the first exemplary embodiment.
Figure 13A:
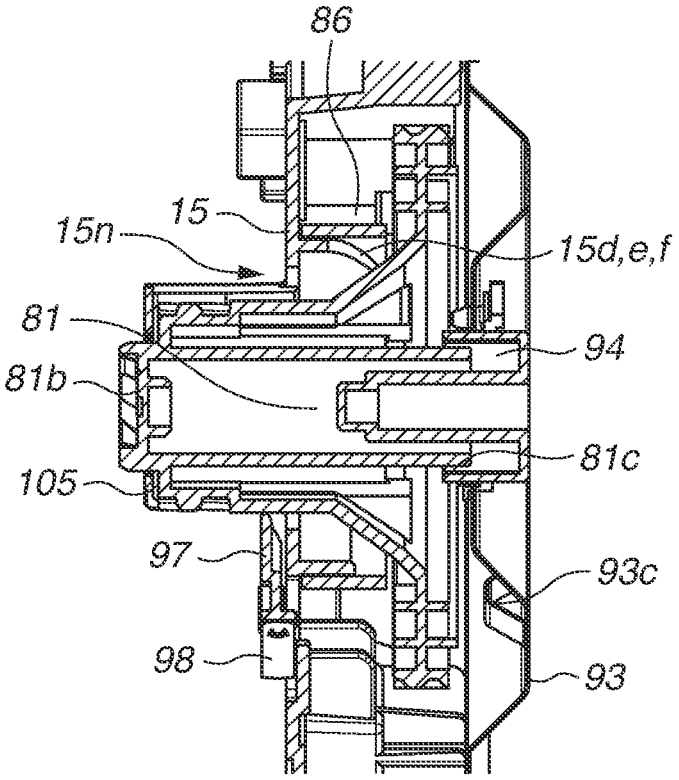
FIG. 13A is a sectional view illustrating an attitude of the drive transmission member during coupling engagement according to the first exemplary embodiment.
Figure 13B:
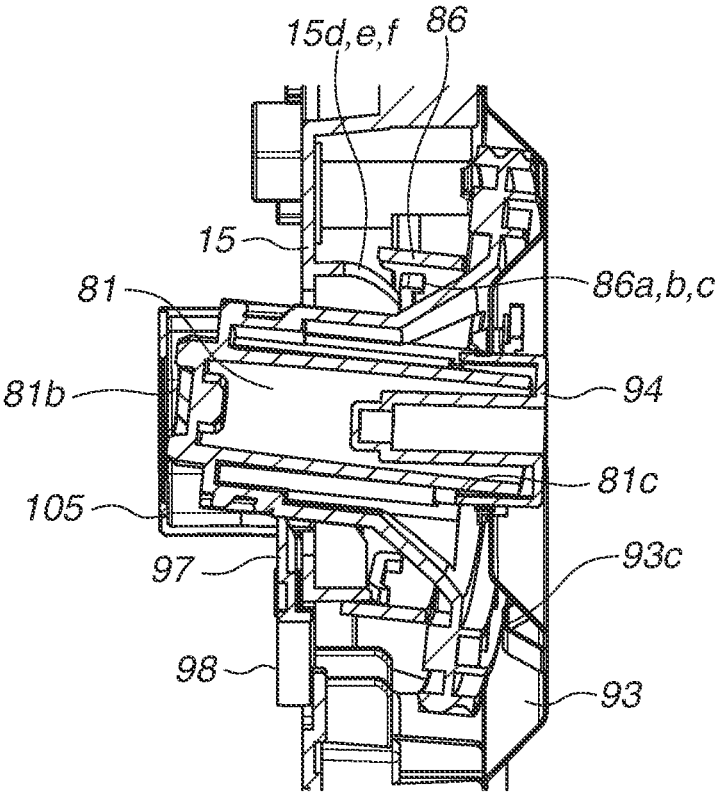
FIG. 13B is a sectional view illustrating an attitude of the drive transmission member when the opening/closing door according to the first exemplary embodiment is opened.
Figure 14:
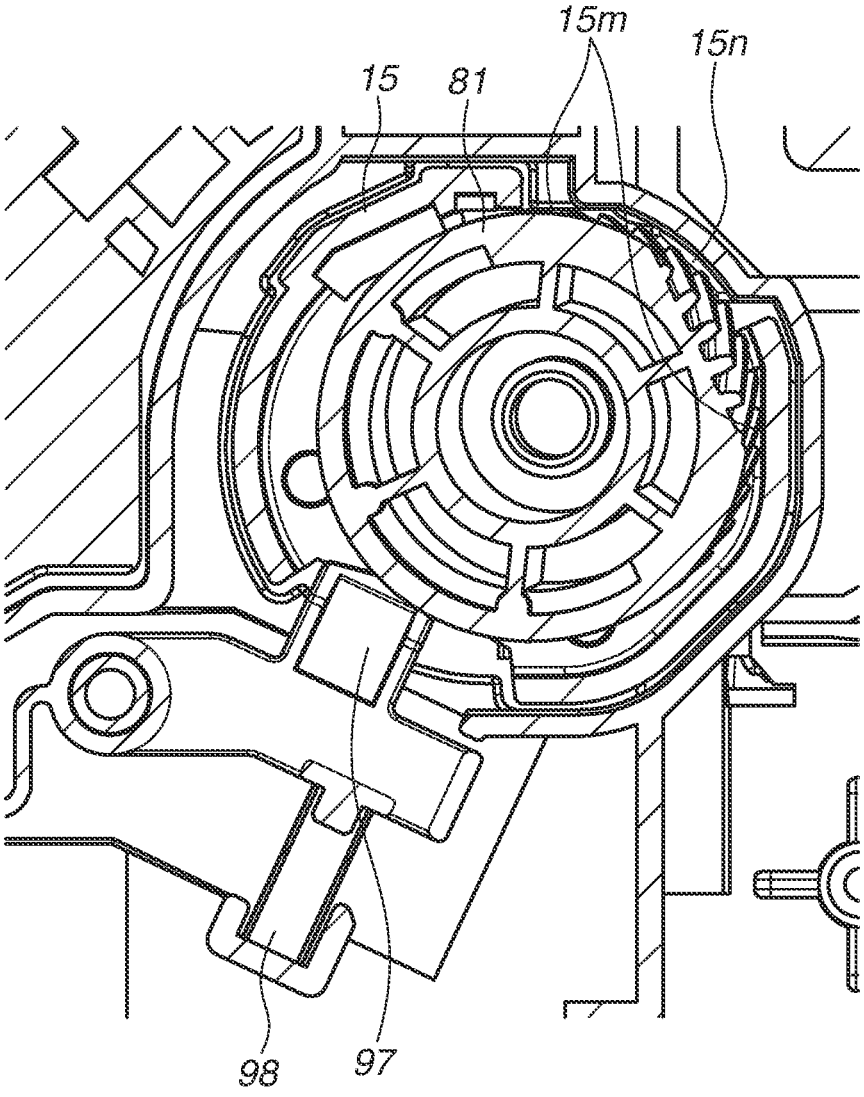
FIG. 14 is a sectional view illustrating an attitude of the drive transmission member when the opening/closing door according to the first exemplary embodiment is opened.

FIG. 12 is a perspective view illustrating the configuration of the bearing 94 that supports the drive transmission member 81 on the driving side. FIGS. 13A and 13B are sectional views each illustrating the attitude of the drive transmission member 81. FIG. 13A is a sectional view illustrating the attitude of the drive transmission member 81 during coupling engagement. FIG. 13B is a sectional view illustrating the attitude of the drive transmission member 81 when the opening/closing door 13 is opened. FIG. 14 is a sectional view illustrating the attitude of the drive transmission member 81 when the opening/closing door 13 is opened.

As described above, the drive transmission member 81 includes the output gear portion 81*a* and the coupling concave portion 81*b* on the leading end side thereof. The drive transmission member 81 is movable in the longitudinal direction. Further, the drive transmission member 81 can be inclined with respect to the axis.

As described above, when the output gear portion 81*a* drives the input gear portion 30*a* to cause the coupling concave portion 81*b* to engage with the coupling convex portion 63*b*, it may be desirable to reduce the inclination angle of the drive transmission member 81 with respect to the photosensitive drum 62. Accordingly, as described above, the cartridge B is provided with the regulation portion 73*j* to reduce the inclination angle of the drive transmission member 81 during driving of the drive transmission member 81.

On the other hand, to dismount the cartridge B from the apparatus body A, the output gear portion 81*a* of the drive transmission member 81 needs to release the meshing with the input gear portion 30*a* of the development roller gear 30. To smoothly release the meshing, the output gear portion 81*a* of the drive transmission member 81 may be inclined in a direction away from the input gear portion 30*a*. Inclining the drive transmission member 81 makes it possible for the cartridge B to be smoothly dismounted from the apparatus body A (mounting portion Q).

To incline the drive transmission member 81 and separate the output gear portion 81*a* from the input gear portion 30*a*, the drive transmission member 81 can be inclined so as not to contact the regulation portion 73*j* when the cartridge B is dismounted.

In addition, it may be desirable to make it easy to incline the drive transmission member 81 in order to release the meshing of the gears, while it may be desirable for the output gear portion 81*a* to reliably mesh with the input gear portion 30*a* of the development roller gear 30 during mounting of the cartridge B. In other words, during mounting of the cartridge B, it may be desirable to hold the drive transmission member 81 at a predetermined inclination angle so that the gears can reliably mesh with each other. Accordingly, the apparatus body A supports the drive transmission member 81 so that the drive transmission member 81 can be easily inclined. When the cartridge B is mounted or dismounted, the apparatus body A inclines the drive transmission member 81 so as to take a favorable attitude and a favorable angle.

A support structure of the one end portion 81*c* of the drive transmission member 81 will be described with reference to FIG. 12.

The apparatus body A includes a support side plate (second driving-side side plate) 93. In the longitudinal direction, the support side plate 93 is provided on the outside of the first side plate 15. As illustrated in FIG. 12, the support side plate 93 is a sheet metal (plate-like metal) and a hole portion 93*a* is provided by drawing this sheet metal. The bearing 94 is fitted into the hole portion 93*a* of the support side plate 93. The drive transmission member 81 is rotatably supported by the bearing 94. Specifically, the one end portion 81*c* of the drive transmission member 81 is supported by the bearing 94.

There is a gap between the bearing 94 and the one end portion 81*c* of the drive transmission member 81. In the present exemplary embodiment, the size of the gap is approximately 0.9 mm. This gap enables the drive transmission member 81 to be inclined.

As illustrated in FIG. 12, a V-shaped portion 94*a* is provided on the inner periphery of the bearing 94. The V-shaped portion 94*a* is formed of two projecting portions that project from an inner peripheral portion of the bearing 94.

As described above, there is a gap between the bearing 94 and the one end portion 81*c* of the drive transmission member 81, and this gap enables the drive transmission member 81 to be inclined. However, when the drive transmission member 81 transmits a driving force to the cartridge B, it may be desirable to match the axis of the drive transmission member 81 with the axis Ax1 of the photosensitive drum 62. Specifically, when the drive transmission member 81 is driven, the drive transmission member 81 may be accurately supported by the bearing 94, without being inclined with respect to the bearing 94. When the drive transmission member 81 is driven, the rear end side of the drive transmission member 81 is brought into contact with the V-shaped portion 94*a*, thereby allowing the drive transmission member 81 to be accurately supported in a substantially horizontal state. The V-shaped portion 94*a* is an attitude determination portion (attitude holding portion) that holds the attitude of the drive transmission member 81.

A convex portion 94*b* serving as a rotation stopping portion is provided on the bearing 94 so as to prevent the bearing 94 from being rotated with respect to the support side plate 93. On the other hand, the support side plate 93 is provided with a hole portion 93*b*. The convex portion 94*b* and the hole portion 93*b* are fitted to each other to thereby fix the phase of the bearing 94. In other words, the bearing 94 is fixed so as not to be rotated with respect to the support side plate 93. Thus, the phase of the V-shaped portion 94*a* provided on the bearing 94 is also fixed.

The support side plate 93 is provided with a driving idler gear (not illustrated), and the driving force from the motor is transmitted from the driving idler gear to a second gear portion 81*j* (see FIG. 10) of the drive transmission member 81. As illustrated in FIG. 10, the V-shaped portion 94*a* is provided in the vicinity of the second gear portion 81*j* of the drive transmission member 81 in the axial direction. The drive transmission member 81 is inclined with the one end portion 81*c* of the drive transmission member 81 as a fulcrum.

In the axial direction of the drive transmission member 81, the inclination fulcrum of the drive transmission member 81 and the position of the second gear portion 81*j* of the drive transmission member 81 are close to each other. Accordingly, even when the drive transmission member 81 is inclined, the meshing of the second gear portion 81*j* and the driving idler gear can be stabilized. More specifically, a change in the distance between the axis of the driving idler gear and the axis of the second gear portion 81*j* and a misalignment in tooth trace can be reduced.

The V-shaped portion 94*a* is disposed at a position where the drive transmission member 81 can be stably held when the driving idler gear and the second gear portion 81*j* mesh with each other. Specifically, in the direction of the meshing force obtained when the driving idler gear and the second gear portion 81*j* mesh with each other, the V-shaped portion

94*a* is disposed on the downstream side of the one end portion 81*c* and the one end portion 81*c* is brought into contact with the V-shaped portion 94*a* of the bearing 94. This configuration enables the drive transmission member 81 to be stably held. Further, the V-shaped portion 94*a* is disposed such that the distance between the axis of the driving idler gear and the axis of the second gear portion 81*j* of the drive transmission member 81 is set to an appropriate distance when the rear end side of the drive transmission member 81 contacts the V-shaped portion 94*a*. In other words, the drive transmission member 81 is held at a position where the driving idler gear and the drive transmission member 81 can mesh with each other.

With this configuration, when the driving force is not acting on the drive transmission member 81, the drive transmission member 81 can be inclined with the rear end side of the drive transmission member 81 as a fulcrum. When the driving force is applied to the drive transmission member 81, the drive transmission member 81 is urged by the V-shaped portion 94*a*, so that the drive transmission member 81 is in a first attitude in which the distance between the axis of the second gear portion 81*j* of the drive transmission member 81 and the axis of the driving idler gear can be accurately determined. As a result, the driving force can be accurately transmitted to the drive transmission member 81.

Next, a support structure on the side of the coupling concave portion 81*b* (leading end side, free end side, non-driving side) of the drive transmission member 81 will be described with reference to FIGS. 13A, 13B, and 14.

As illustrated in FIG. 13A, the first side plate 15 includes a space 15*n*. As illustrated in FIG. 13A, when the coupling concave portion 81*b* is engaged with the coupling convex portion 63*b*, the space 15*n* forms a gap between the drive transmission member 81 and the first side plate 15. The space 15*n* of the first side plate 15 is disposed at a position opposed to the input gear portion 30*a* of the development roller gear 30.

On the other hand, the first side plate 15 is provided with the inclination member 98 that is urged by the inclining urging spring 97 to incline the drive transmission member 81. The urging direction of the inclination member 97 is set such that the output gear portion 81*a* of the drive transmission member 81 is separated from the development roller gear 30. The inclination member 97 inclines the drive transmission member 81 in a direction in which the output gear portion 81*a* is separated from the development roller gear 30.

As illustrated in FIG. 13B, when the opening/closing door 13 is opened, the drive transmission member 81 can take a second attitude in which the axis of the drive transmission member 81 is inclined by the inclination member 97. The drive transmission member 81 that is in the second attitude is inclined by the inclination member 97 such that the drive transmission member 81 is inserted into the space 15*n* of the first side plate 15. In other words, the drive transmission member 81 is inclined in a direction in which the output gear portion 81*a* of the drive transmission member 81 is separated from the input gear portion 30*a* of the development roller gear 30. Accordingly, a gap is formed between the output gear portion 81*a* and the input gear portion 30*a* in a rotation radius direction of the output gear portion 81*a* of the drive transmission member 81 and the input gear portion 30*a* of the development roller gear 30.

The inclination member 97 is configured to constantly urge the drive transmission member 81. As described above, when the coupling concave portion 81*b* is engaged with the coupling convex portion 63*b*, the axis of the coupling concave portion 81*b* matches the axis of the coupling convex portion 63*b*. Accordingly, when the coupling concave portion 81*b* is engaged with the coupling convex portion 63*b*, the position of the coupling concave portion 81*b* is determined by the coupling convex portion 63*b* even when the drive transmission member 81 is urged by the inclination member 97.

As illustrated in FIG. 14, the space 15*n* of the first side plate 15 is provided with a V-shaped portion 15*m* as a bearing (holding portion) of the drive transmission member 81. The V-shaped portion 15*m* supports the drive transmission member 81 inclined by the inclination member 97 when the cartridge B is not mounted. In a state where the drive transmission member 81 is held by the V-shaped portion 15*m*, a gap is formed between the output gear portion 81*a* and the input gear portion 30*a* of the development roller gear 30. Thus, the meshing of the gears can be released during dismounting of the cartridge B.

<Configuration of Movable Regulation Member of Cartridge>

Next, a movable regulation member 101 of the cartridge B will be described with reference to FIGS. 15A, 15B, and 16.

Figure 15A:
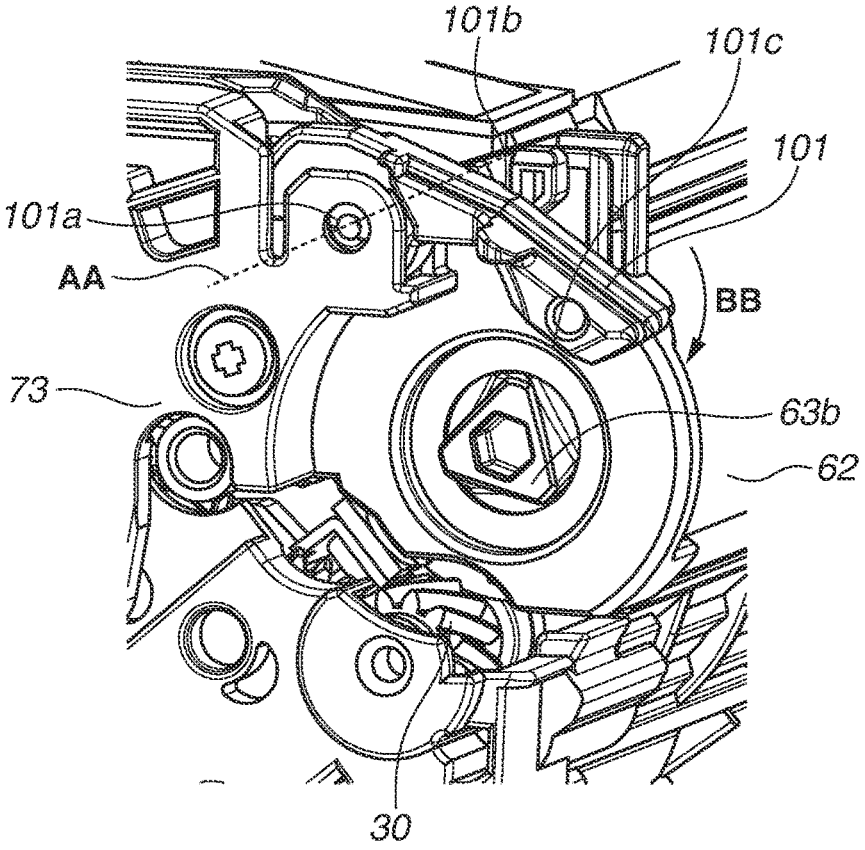
FIG. 15A is a perspective view illustrating a portion near a movable regulation member according to the first exemplary embodiment as viewed from the driving side of the cartridge.
Figure 15B:
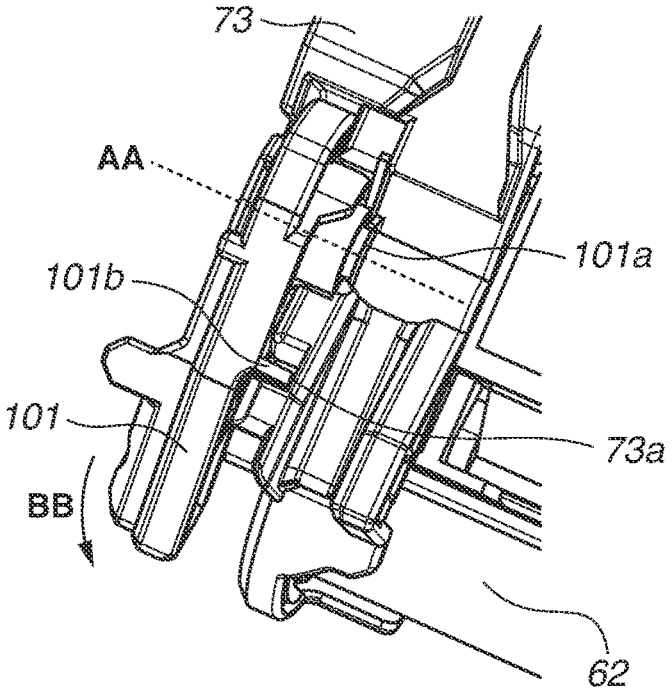
FIG. 15B is a perspective view illustrating a portion near the movable regulation member according to the first exemplary embodiment as viewed along a direction crossing an axis of a photosensitive drum.
Figure 16:
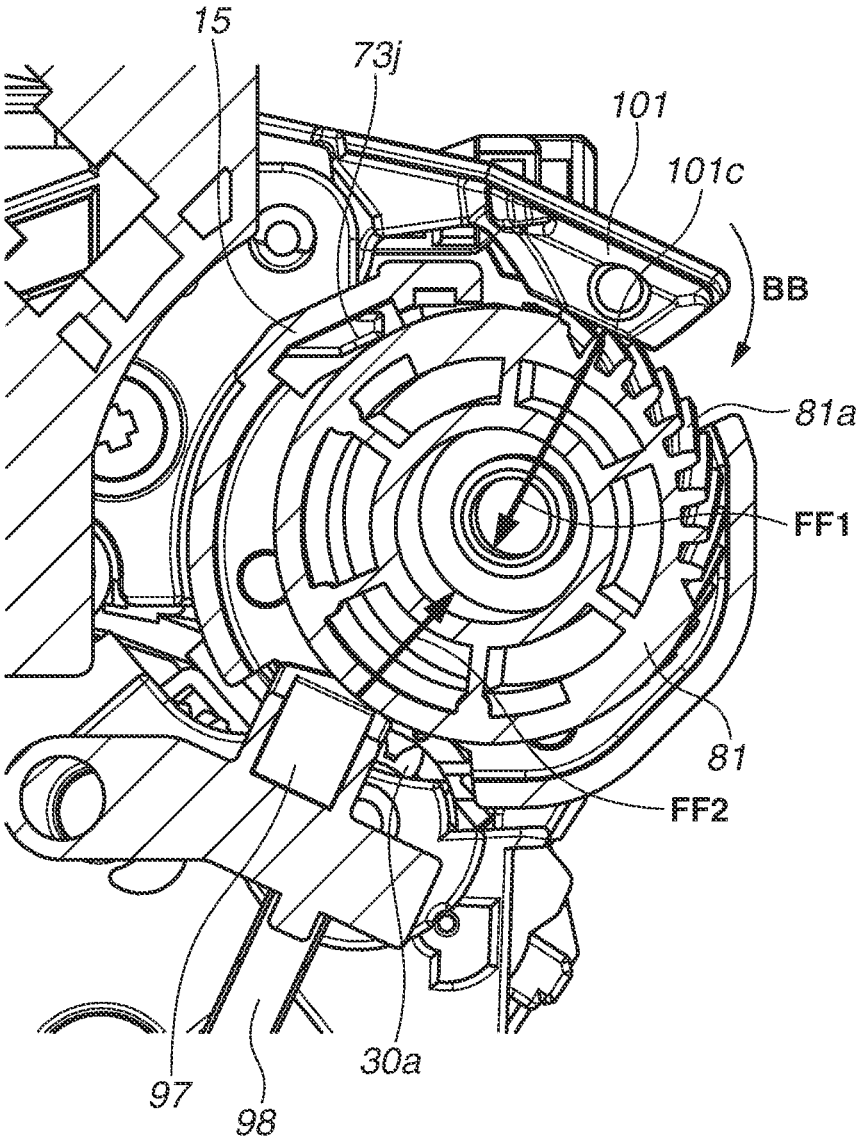
FIG. 16 is a sectional view illustrating an inclination operation of the drive transmission member during mounting of the cartridge according to the first exemplary embodiment.

FIGS. 15A and 15B are perspective views each illustrating the movable regulation member 101 of the cartridge B. FIG. 15A is a perspective view illustrating a portion near the movable regulation member 101 as viewed from the driving side of the cartridge B. FIG. 15B is a perspective view illustrating a portion near the movable regulation member 101 as viewed along a direction crossing the axis of the photosensitive drum 62. FIG. 16 is a sectional view illustrating an inclination operation of the drive transmission member 81 when the cartridge B is mounted.

As illustrated in FIG. 15A, the movable regulation member (second regulation portion, alignment assist member, movable member, urging member, alignment member) 101 which is a member that regulates the attitude of the drive transmission member 81 is disposed on the driving side of the cartridge B. The movable regulation member 101 is movable with respect to the photosensitive drum 62. Further, the movable regulation member 101 is movable with respect to the coupling convex portion 63*b* and the development roller gear 30. The movable regulation member 101 is attached to the drum bearing 73 through a support projection 101*a*. The movable regulation member 101 is attached rotatably about an axis AA of the support projection 101*a*.

As illustrated in FIGS. 15A and 15B, the support projection 101*a* is urged in a direction indicated by an arrow BB by an urging spring. In the present exemplary embodiment, the urging spring is a helical torsion coil spring. On the other hand, the drum bearing 73 is provided with a contact portion (stopping portion) 73*a* which contacts the movable regulation member 101 and defines a rotation range of the movable regulation member 101. Since the movable regulation member 101 is urged by the urging spring in the direction indicated by the arrow BB, a contacted portion 101*b* of the movable regulation member 101 is in an attitude contacting the contact portion 73*a*. In other words, the contact portion 73*a* contacts the movable regulation member 101 to thereby stop the movement of the movable regulation member 101.

As viewed along the direction of the axis Ax1 of the photosensitive drum 62, an acting portion 101*c* of the movable regulation member 101 is disposed in the vicinity of a surface 62*b* of the photosensitive drum 62. The position of the movable regulation member 101 in a state where the movable regulation member 101 contacts the contact portion

73*a* is referred to as an acting position of the movable regulation member 101. The acting portion 101*c* of the movable regulation member 101 is disposed on the outside of the coupling convex portion 63*b* in the longitudinal direction.

Next, an operation of the movable regulation member 101 during mounting of the cartridge B will be described with reference to FIG. 16.

As described above, when the cartridge B is not mounted on the apparatus body A, the drive transmission member 81 is inclined by the inclination member 97. The drive transmission member 81 receives an urging force FF2 from the inclination member 97.

When the cartridge B is inserted and the opening/closing door 13 is closed, the cartridge B is pressed by the cartridge pressing members 1 and 2 and the cartridge B is mounted on the mounting portion Q. In this case, the movable regulation member 101 contacts a cover portion 105 to be described below and then the movable regulation member 101 is rotated in the direction indicated by the arrow BB as illustrated in FIG. 16. Then, the acting portion 101*c* of the movable regulation member 101 contacts the output gear portion 81*a* of the drive transmission member 81. Accordingly, the drive transmission member 81 receives an urging force FF1 from the acting portion 101*c*.

Therefore, the urging force FF1 received from the acting portion 101*c* and the urging force FF2 received from the inclination member 97 act on the drive transmission member 81. In this case, the urging force FF1 is greater than the urging force FF2. As a result, the degree of inclination of the drive transmission member 81 is decreased. Accordingly, the drive transmission member 81 is moved so that the output gear portion 81*a* of the drive transmission member 81 and the input gear portion 30*a* of the development roller gear 30 mesh with each other. In other words, the movable regulation member 101 urges the drive transmission member 81 inclined by the inclination member 97 so as to allow the meshing of the output gear portion 81*a* with the development roller gear 30.

In a state where the coupling concave portion 81*b* is engaged with the coupling convex portion 63*b* and the rotation axis of the drive transmission member 81 matches the rotation axis of the photosensitive drum 62, the movable regulation member 101 is away from the drive transmission member 81. The regulation portion 73*j* is also away from the drive transmission member 81.

In summary of the above-described operation, the following operation is carried out. That is, when the cartridge B is mounted on the mounting portion Q, the movement of the drive transmission member 81 is first regulated by the movable regulation member 101 of the cartridge B, and the output gear portion 81*a* and the input gear portion 30*a* of the development roller gear 30 mesh with each other. When the driving force is applied to the drive transmission member 81, the inclination of the drive transmission member 81 is regulated by the regulation portion 73*j* and the force generated in the thrust direction due to the meshing of the development roller gear 30 with the input gear portion 30*a* enables the drive transmission member 81 to move in a direction closer to the photosensitive drum 62. Then, the coupling concave portion 81*b* engages with the coupling convex portion 63*b* and the rotation axis of the drive transmission member 81 matches the rotation axis of the photosensitive drum 62.

As described above, even when the drive transmission member 81 is inclined in the apparatus body A, the coupling concave portion 81*b* and the coupling convex portion 63*b* can engage with each other with reduced misalignment between the axis of the coupling concave portion 81*b* and the axis of the coupling convex portion 63*b*.

As described above, the development roller 32 and the photosensitive drum 62 are rotated by the drive transmission member 81.

<Dismounting of Cartridge>

An operation for bringing the opening/closing door 13 of the apparatus body A into an opened state from a closed state will be described with reference to FIGS. 5 and 13B.

An operation for releasing the engagement between the coupling concave portion 81*b* and the coupling convex portion 63*b* will now be described.

As described above, when the opening/closing door 13 is rotated and opened, the cylindrical cam 86 is rotated via the cylindrical cam link 85. When the cylindrical cam 86 is rotated, the slope portions 86*a*, 86*b*, and 86*c* of the cylindrical cam 86 slide along the slope portions 15*d*, 15*e*, and 15*f*, respectively, so that the cylindrical cam 86 is moved to the driving side (see FIG. 5). This movement enables the engagement between the coupling concave portion 81*b* and the coupling convex portion 63*b* to be gradually released. When the opening/closing door 13 is further opened, the coupling concave portion 81*b* and the coupling convex portion 63*b* are separated from each other.

Next, dismounting of the cartridge B from the mounting portion Q will be described.

When the coupling concave portion 81*b* and the coupling convex portion 63*b* are separated from each other, the drive transmission member 81 is inclined by the inclination member 97. More specifically, as illustrated in FIG. 13B, when the opening/closing door 13 is opened, the drive transmission member 81 contacts a projecting portion 93*c* of the support side plate 93 and is inclined. In this case, a gap is formed between the output gear portion 81*a* of the drive transmission member 81 and the input gear portion 30*a* of the development roller gear 30 so as to prevent the output gear portion 81*a* and the input gear portion 30*a* from meshing with each other. As a result, when the cartridge B is pulled out from the apparatus body A, the meshing of the output gear portion 81*a* with the input gear portion 30*a* can be smoothly released. In other words, the cartridge B can be easily pulled out from the apparatus body A.

<Configuration of Cover Portion of Drive Transmission Member>

The cover portion 105 that covers the drive transmission member 81 of the apparatus body A will be described with reference to FIGS. 4, 13A, 13B, 17A, 17B, and 18.

Figure 17A:
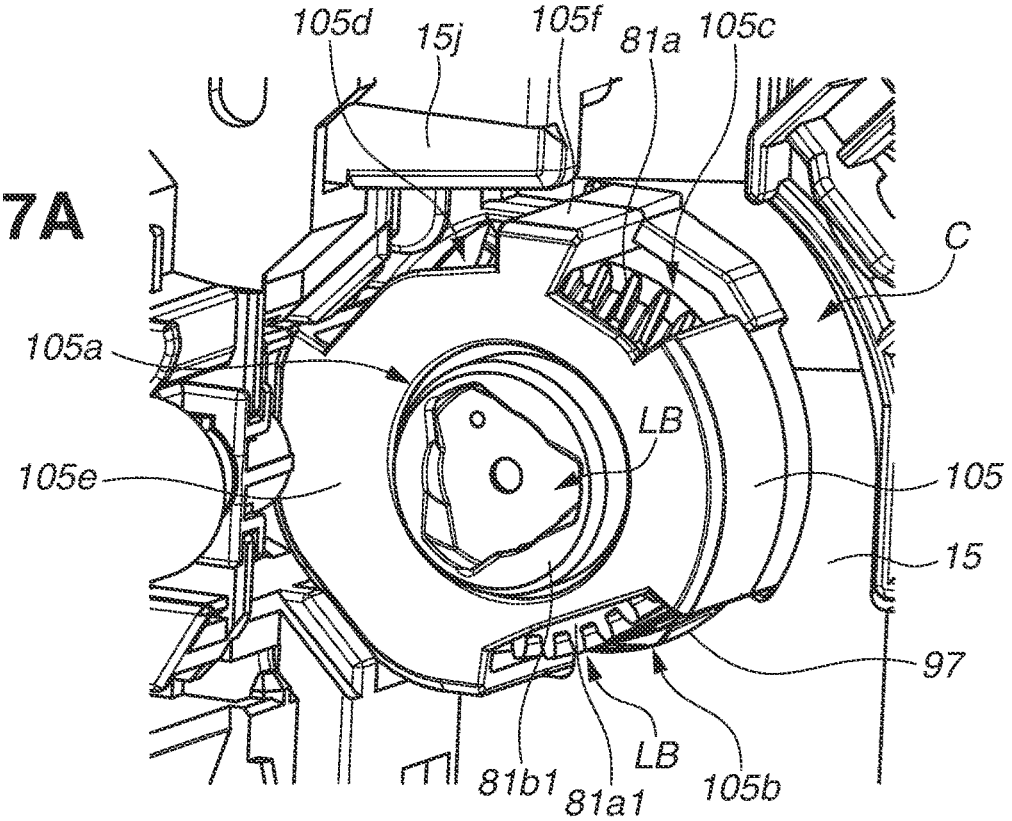
FIG. 17A is a perspective view illustrating the drive transmission member and a cover portion when the coupling concave portion and the coupling convex portion according to the first exemplary embodiment engage with each other.
Figure 17B:
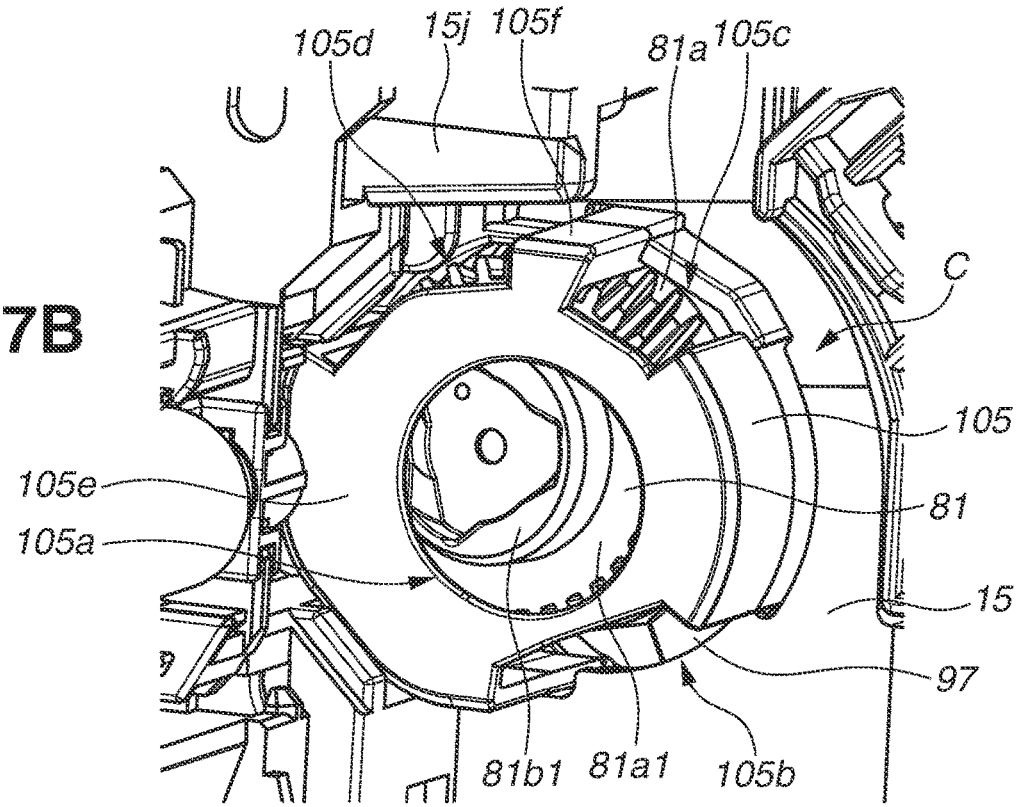
FIG. 17B is a perspective view illustrating the drive transmission member and the cover portion in a state where the opening/closing door according to the first exemplary embodiment is open.
Figure 18:
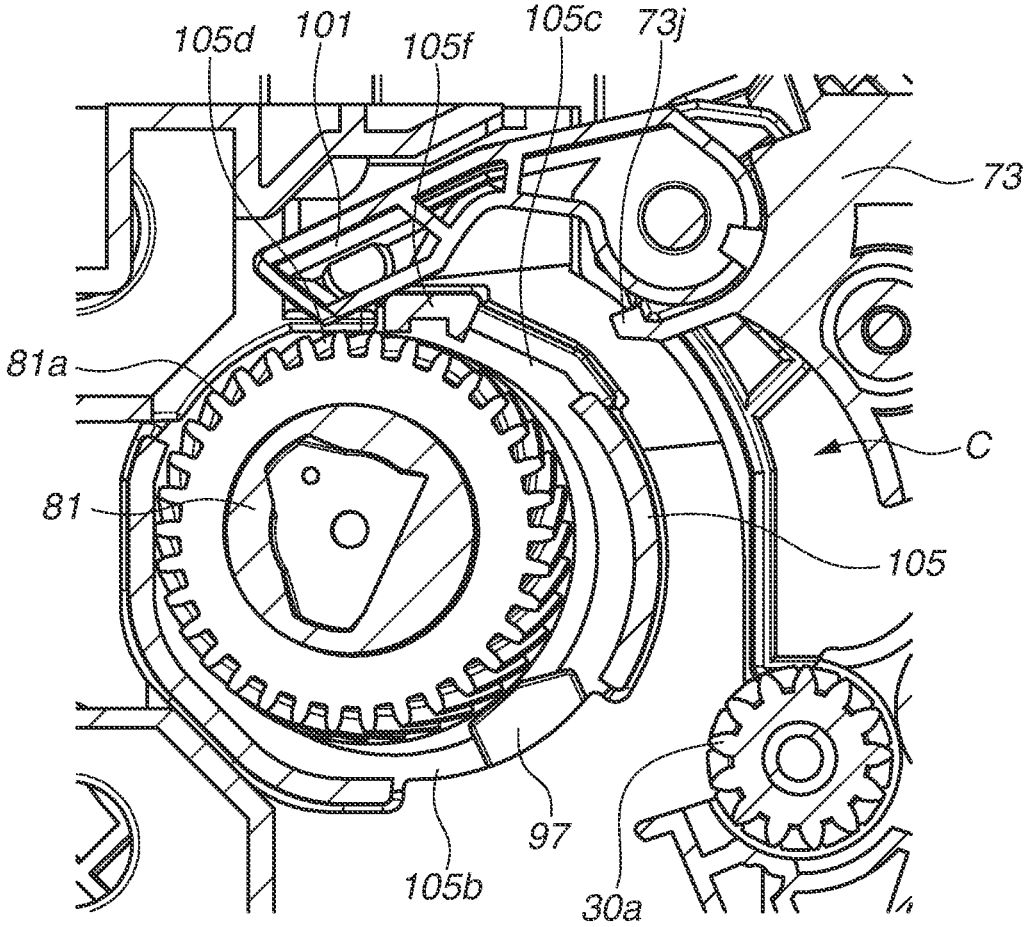
FIG. 18 is a sectional view illustrating an operation of the movable regulation member during mounting and dismounting of the cartridge according to the first exemplary embodiment.

FIGS. 17A and 17B are perspective views each illustrating the drive transmission member 81 and the cover portion 105. FIG. 17A is a perspective view illustrating the drive transmission member 81 and the cover portion 105 when the coupling concave portion 81*b* and the coupling convex portion 63*b* engage with each other. FIG. 17B is a perspective view illustrating the drive transmission member 81 and the cover portion 105 in the state where the opening/closing door 13 is opened. FIG. 18 is a sectional view illustrating an operation of the movable regulation member 101 during mounting and dismounting of the cartridge B.

As illustrated in FIGS. 4, 13A, 13B, 17A, and 17B, the cover portion 105 that covers the drive transmission member 81 is included in the first side plate 15 of the apparatus body A. The cover portion 105 is disposed between the mounting portion Q and the drive transmission member 81 and covers the drive transmission member 81.

To prevent the drive transmission member 81 from being worn, lubricant LB, such as grease, is coated on the drive transmission member 81. The lubricant LB may be coated on at least one of the coupling concave portion 81*b* and the output gear portion 81*a*. If the cover portion 105 is not provided, the drive transmission member 81 is exposed to the mounting portion Q. Accordingly, by covering the drive transmission member 81 with the cover portion 105, a user can be prevented from easily touching the drive transmission member 81. In addition, a part of the drive transmission member 81 is exposed from the cover portion 105, thereby preventing the drive transmission member 81 from interfering with the meshing of the drive transmission member 81 with the development roller gear 30 and the engagement with the coupling convex portion 63*b*.

The lubricant LB need not necessarily be coated on the drive transmission member 81, and the lubricant LB may be coated on the cartridge B (see FIG. 7). In this case, in the process of transmitting the driving force from the drive transmission member 81 to the cartridge B, the lubricant LB is supplied to the drive transmission member 81 from the cartridge B. More specifically, the lubricant LB may be coated on at least one of the input gear portion 30*a* of the development roller gear 30 and the coupling convex portion 63*b*. With this configuration, the lubricant LB can be coated (supplied) on the coupling concave portion 81*b* and the output gear portion 81*a*. In other words, the drive transmission member 81 is configured to receive the lubricant LB from the cartridge B. More specifically, when the lubricant LB is coated on the coupling concave portion 81*b*, the coupling convex portion 63*b* receives the lubricant LB from the coupling concave portion 81*b*. When the lubricant LB is coated on the input gear portion 30*a*, the output gear portion 81*a* receives the lubricant LB from the input gear portion 30*a*.

Alternatively, the lubricant LB may be coated on both the drive transmission member 81 and the cartridge B.

The cover portion 105 includes a non-driving-side end face 105*e*. The non-driving-side end face 105*e* is a surface formed along a direction crossing the rotation axis of the drive transmission member 81 (perpendicular direction in the present exemplary embodiment) in a state where the drive transmission member 81 is located at the engagement position. In a driving state (state where the drive transmission member 81 is located at the engagement position), the non-driving-side end face 105*e* is located between the end face 81*a*1 of the output gear portion 81*a* in the drive transmission member 81 and the drum bearing 73 of the cartridge B in the longitudinal direction. Further, the cover portion 105 is disposed to form a gap between the cartridge B and the cover portion 105 in the axial direction of the photosensitive drum 62, and is disposed so as not to interfere with the cartridge B during mounting of the cartridge B.

In the present exemplary embodiment, the cover portion 105 includes four openings (105*a*, 105*b*, 105*c*, and 105*d*).

The cover portion 105 includes the first opening 105*a* for exposing the coupling concave portion 81*b*. The first opening 105*a* is disposed on the non-driving-side end face 105*e*. The first opening 105*a* is provided at a position where the coupling cylindrical portion 81*i* of the drive transmission member 81 projects in the driving state. The first opening 105*a* is disposed at a position where the coupling concave portion 81*b* and the coupling convex portion 63*b* engage with each other.

In other words, the first opening 105*a* allows the coupling concave portion 81*b* to be exposed to the mounting portion Q and the coupling convex portion 63*b*. This allows the engagement between the coupling concave portion 81*b* and the coupling convex portion 63*b*.

The position of the non-driving-side end face 105*e* of the cover portion 105 in the longitudinal direction is a position where the leading end 81*b*1 of the coupling concave portion 81*b* projects toward the non-driving-side end face 105*e* in the driving state. Further, in the state where the opening/closing door 13 is opened, the drive transmission member 81 is located at the retracted position. Accordingly, the leading end 81*b*1 of the coupling concave portion 81*b* is prevented from projecting from the non-driving-side end face 105*e* of the cover portion 105. In other words, when the drive transmission member 81 is located at the retracted position, the non-driving-side end face 105*e* overlaps the coupling concave portion 81*b* and covers the coupling concave portion 81*b* as viewed along the direction of the axis Ax1 of the photosensitive drum 62.

The cover portion 105 includes the second opening 105*b* for exposing the output gear portion 81*a*. The second opening 105*b* is disposed at a position where the output gear portion 81*a* of the drive transmission member 81 and the input gear portion 30*a* of the development roller gear 30 mesh with each other in the driving state.

In other words, the second opening 105*b* allows the output gear portion 81*a* to be exposed to the mounting portion Q and the development roller gear 30, thereby allowing the output gear portion 81*a* and the development roller gear 30 to mesh with each other.

In the mounting direction C of the cartridge B, the second opening 105*b* is disposed on a side surface of the cover portion 105 so as to be located on the upstream side of the center of the drive transmission member 81. In the vertical direction, the second opening 105*b* is disposed on the lower side of the cover portion 105. In the state where the opening/closing door 13 is opened, the output gear portion 81*a* of the drive transmission member 81 is inclined in a direction away from the input gear portion 30*a* of the development roller gear 30 by the inclination member 97. That is, the drive transmission member 81 is inclined in a direction away from the second opening 105*b*.

The cover portion 105 includes the third opening 105*c* for exposing the drive transmission member 81 toward the regulation portion 73*j*. The third opening 105*c* is disposed at a position corresponding to the position of the regulation portion 73*j*. In the mounting direction C of the cartridge B, the third opening 105*c* is disposed on a side surface of the cover portion 105 so as to be located on the upstream side of the center of the drive transmission member 81. The third opening 105*c* allows the regulation portion 73*j* to regulate the drive transmission member 81 even when the cartridge B includes the regulation portion 73*j*.

In the state where the opening/closing door 13 is opened, the output gear portion 81*a* of the drive transmission member 81 is inclined toward the downstream side in the mounting direction C of the cartridge B by the inclination member 97. Accordingly, the output gear portion 81*a* is disposed at a position away from the third opening 105*c*.

The cover portion 105 includes the fourth opening 105*d* for exposing the drive transmission member 81 toward the movable regulation portion 101. The fourth opening 105*d* is disposed at a position where the movable regulation member 101 of the cartridge B and the output gear portion 81*a* of the drive transmission member 81 approach each other in the driving state. The fourth opening 105*d* allows the movable regulation member 101 to regulate the movement of the drive transmission member 81 even when the cartridge B includes the movable regulation portion 101.

In the mounting direction C of the cartridge B, the fourth opening 105*d* is disposed on a side surface of the cover portion 105 so as to be located on the downstream side of the center of the drive transmission member 81. In the vertical direction, the fourth opening 105*d* is disposed on the upper side of the cover portion 105. In other words, the fourth opening 105*d* is disposed on the opposite side of the second opening 105*b*.

As illustrated in FIG. 18, the cover portion 105 includes a guide portion 105*f* that is located between the third opening 105*c* and the fourth opening 105*d* and serves as a guide for operating the movable regulation member 101 during mounting and dismounting of the cartridge B. The guide portion 105*f* guides the leading end of the movable regulation member 101, thereby guiding the movable regulation member 101 to the fourth opening 105*d*.

As described above, when the cartridge B is mounted on the apparatus body A, the output gear portion 81*a* of the drive transmission member 81 is disposed in the space 87 of the cartridge B. The cover portion 105 is also disposed in the space 87. The presence of the space 87 allows mounting of the cartridge B on the apparatus body A, while preventing the drive transmission member 81 from interfering with the cartridge B, during mounting of the cartridge B on the apparatus body A.

As described above, in the present exemplary embodiment, the cover portion 105 that covers the drive transmission member 81 of the apparatus body A is provided. This configuration prevents the user from easily touching the drive transmission member 81 even in a state where the cartridge B configured to be detachably mounted on the apparatus body A is removed from the apparatus body A. In other words, it is possible to prevent the user from touching the lubricant LB coated on the drive transmission member 81.

In the present exemplary embodiment, the first opening 105*a*, the second opening 105*b*, the third opening 105*c*, and the fourth opening 105*d* of the cover portion 105 are disposed independently. However, the number of the openings and the shape and arrangement of the opening are not particularly limited. For example, these openings may be connected together, the number of the openings may be increased, the shape of each of the openings may be changed, or the arrangement of the openings may be moved.

For example, the first opening 105*a* and the second opening 105*b* may be connected together. The first opening 105*a* and the third opening 105*c* may be connected together. The first opening 105*a* and the fourth opening 105*d* may be connected together. The second opening 105*b* and the third opening 105*c* may be connected together. The second opening 105*b* and the fourth opening 105*d* may be connected together. The third opening 105*c* and the fourth opening 105*d* may be connected.

Next, a second exemplary embodiment will be described. Descriptions of components of the second exemplary embodiment that correspond to the components of the first exemplary embodiment are omitted. In the second exemplary embodiment, members corresponding to the members described in the first exemplary embodiment are denoted by the same reference symbols as those of the first exemplary embodiment. Differences from the first exemplary embodiment will be mainly described in the second exemplary embodiment.

The apparatus body A according to the second exemplary embodiment includes a cylindrical cam 186 (corresponding to the cylindrical cam 86 according to the first exemplary embodiment), and a drive transmission member 181 (corresponding to the drive transmission member 81 according to the first exemplary embodiment) that engages with the cylindrical cam 186. The drive transmission member 181 includes a coupling concave portion 181*b*. The coupling concave portion 181*b* engages with the coupling convex portion 63*b* of the cartridge B. The engagement between the coupling concave portion 181*b* and the coupling convex portion 63*b* is hereinafter referred to as "coupling engagement".

In the present exemplary embodiment, an operation for inclining the drive transmission member 181 after the coupling engagement is released and an operation of the cylindrical cam 186 to be performed when the coupling engagement is released will be described in detail.

<Operation for Releasing Coupling Engagement of Drive Transmission Member>

Figure 20:
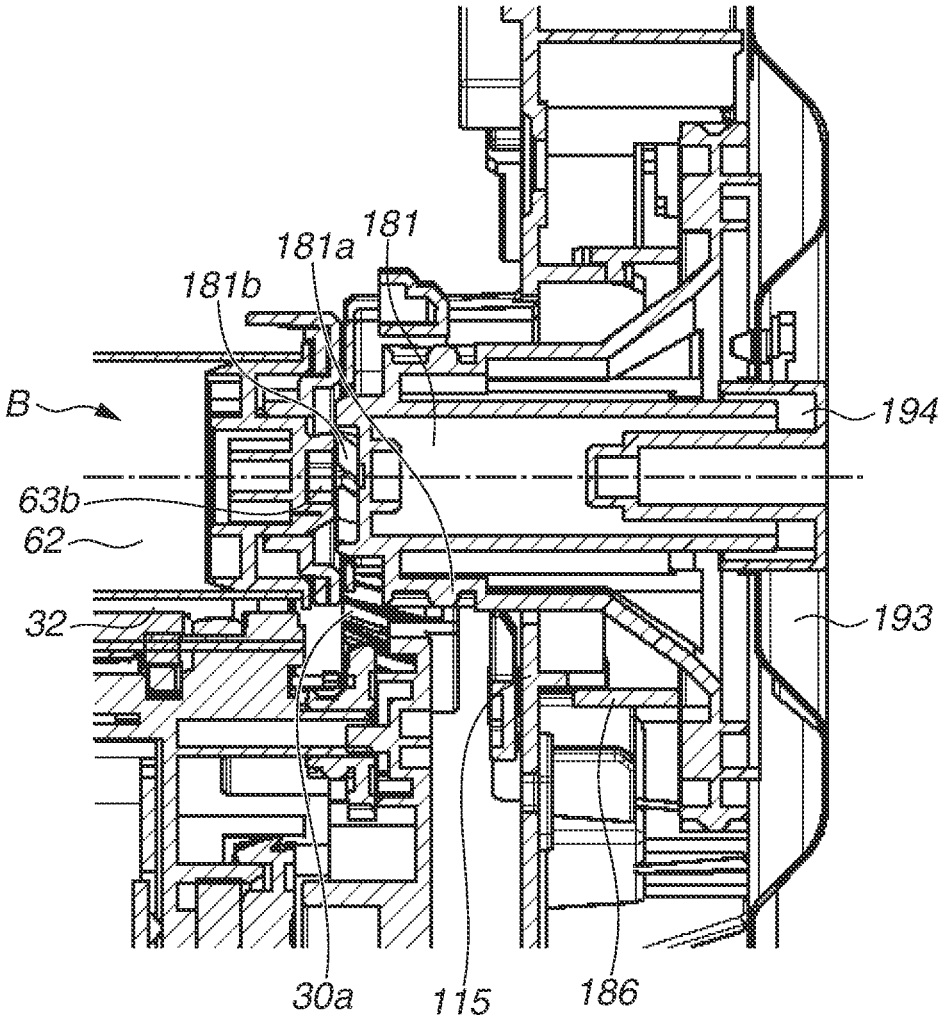
FIG. 20 is a sectional view illustrating a state where coupling engagement according to the second exemplary embodiment is released and a drive transmission member is not inclined.
Figure 21:
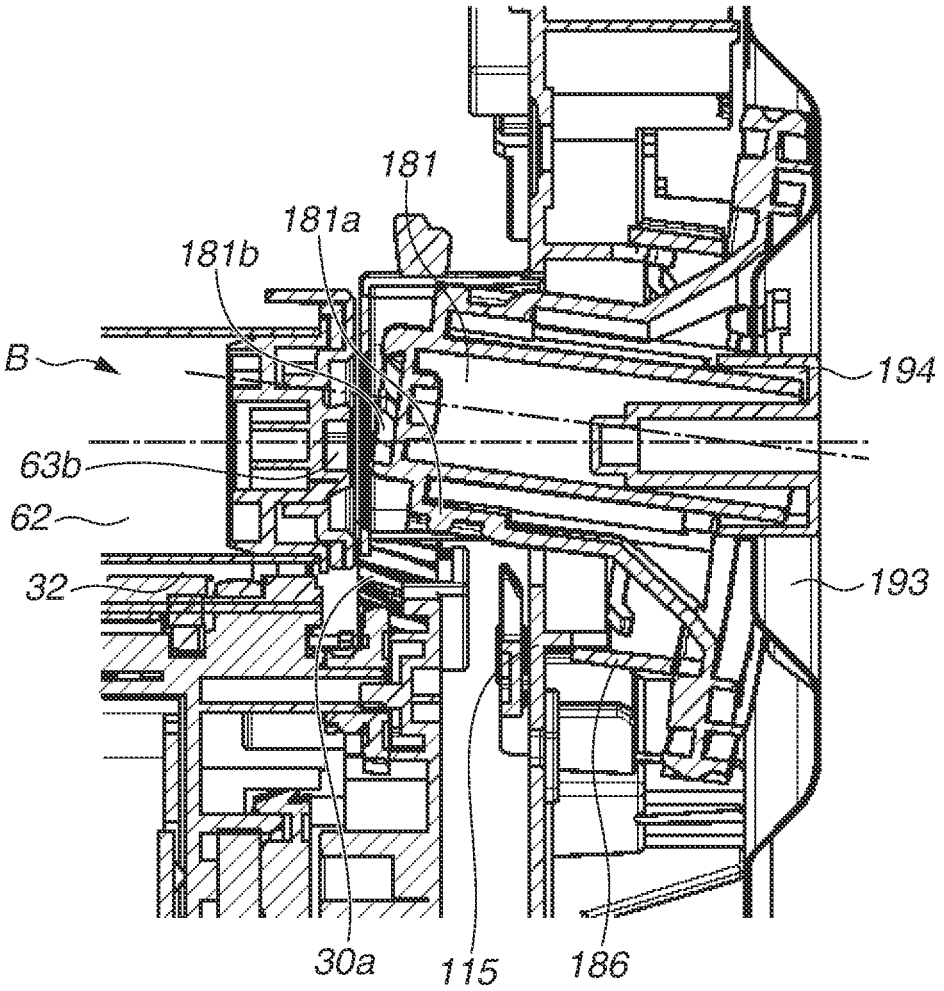
FIG. 21 is a sectional view illustrating a state where the coupling engagement according to the second exemplary embodiment is released and the drive transmission member is inclined.

The operation for releasing the coupling engagement and the operation for inclining the drive transmission member 181 will be described with reference to FIGS. 19 to 21. After that, the operation of the cylindrical cam 186 will be described with reference to FIGS. 22 to 25.

Figure 19:
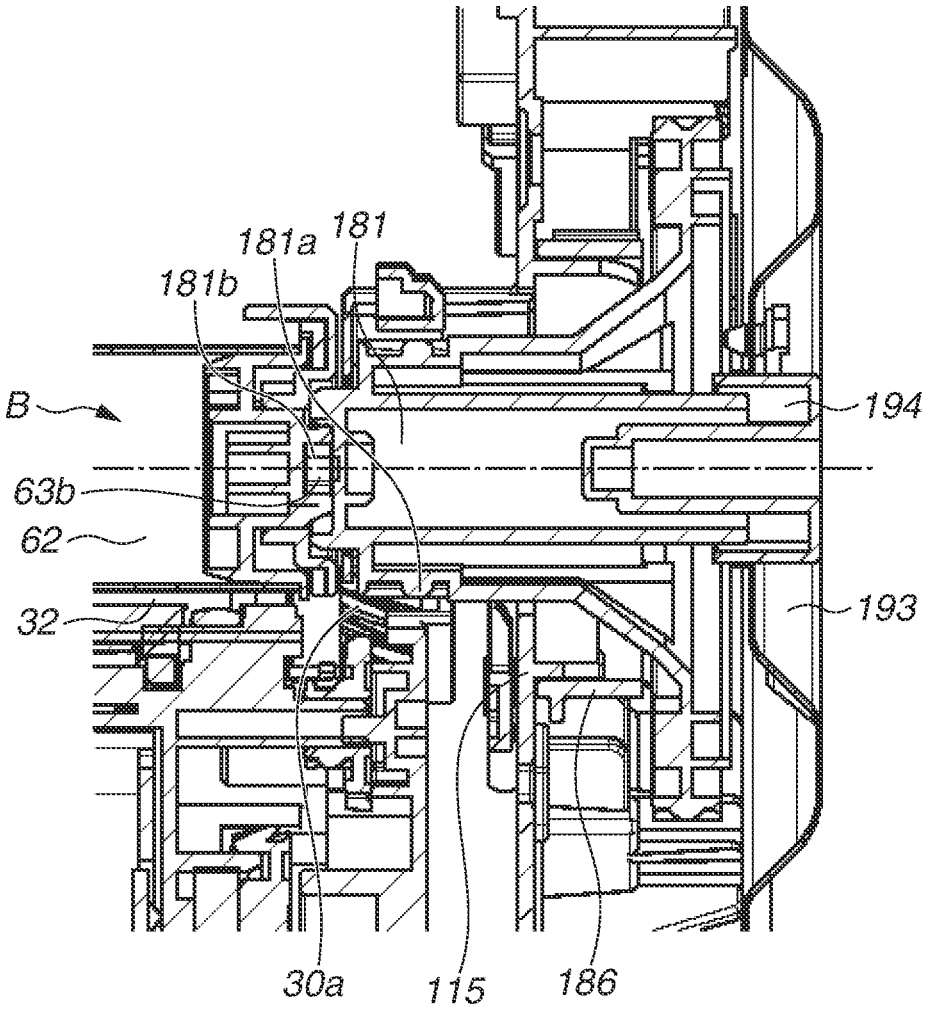
FIG. 19 is a sectional view illustrating a state where a coupling concave portion and a coupling convex portion according to a second exemplary embodiment engage with each other.

FIG. 19 is a sectional view illustrating a state where the coupling concave portion 181*b* and the coupling convex portion 63*b* engage with each other. FIG. 20 is a sectional view illustrating a state where the coupling engagement is released and the drive transmission member 181 is not inclined. FIG. 21 is a sectional view illustrating a state where the coupling engagement is released and the drive transmission member 181 is inclined.

As illustrated in FIG. 19, the apparatus body A includes the cylindrical cam 186 and the drive transmission member 181. The drive transmission member 181 is configured to transmit a driving force to the cartridge B when the coupling concave portion 181*b* engages with the coupling convex portion 63*b* of the cartridge B. The cylindrical cam 186 is disposed to be located between the drive transmission member 181 and the first side plate 115 of the apparatus body A.

The apparatus body A includes a bearing 194 that supports the drive transmission member 181. The driving side of the apparatus body A is provided with a support side plate 193 and the bearing 194 is mounted on the support side plate 193.

Like in the first exemplary embodiment, in the state where the opening/closing door 13 of the apparatus body A is closed, the coupling concave portion 181*b* engages with the coupling convex portion 63*b* of the cartridge B and the development roller 32 and the photosensitive drum 62 are rotated by the drive transmission member 181.

The position of the drive transmission member 181 that transmits the driving force to the cartridge B is referred to as a first position. When the drive transmission member 181 is located at the first position, the coupling concave portion 181*b* engages with the coupling convex portion 63*b* of the cartridge B and the drive transmission member 181 is not inclined. In this state, the rotation axis of the drive transmission member 181 is substantially parallel to the rotation axis of the photosensitive drum 62 and the rotation axis of the drive transmission member 181 matches the rotation axis of the photosensitive drum 62. The attitude of the drive transmission member 181 at this time is referred to as a first attitude of the drive transmission member 181. FIG. 19 illustrates that the drive transmission member 181 is located at the first position.

The position of the drive transmission member 181 when the coupling engagement is released and the drive transmission member 181 is not inclined is referred to as a second position of the drive transmission member 181. The attitude of the drive transmission member 181 at this time is referred to as a second attitude of the drive transmission member 181. In FIG. 20, the drive transmission member 181 is located at the second position.

The cylindrical cam 186 is mounted on the first side plate 115 so as to be rotatable and movable in the longitudinal direction. The cylindrical cam 186 is linked to the opening/closing door 13 for opening and closing the mounting portion Q. When the opening/closing door 13 begins to open, the cylindrical cam 186 is rotated and moved in the direction away from the cartridge B in the longitudinal direction.

When the cylindrical cam 186 is moved in the direction away from the cartridge B, the drive transmission member 181 is also moved in the direction away from the cartridge B in conjunction with the cylindrical cam 186. Accordingly, the coupling concave portion 181*b* of the drive transmission member 181 is separated from the coupling convex portion 63*b*, so that the coupling engagement is released. The cylindrical cam 186 and the drive transmission member 181 are moved in a direction parallel to the axial direction (rotation axis direction) of the drive transmission member 181 located at the first position, and are not inclined. The drive transmission member 181 is now located at the second position. In this state, the rotation axis of the drive transmission member 181 is substantially parallel to the rotation axis of the photosensitive drum 62, and the rotation axis of the drive transmission member 181 matches the rotation axis of the photosensitive drum 62.

When the drive transmission member 181 is located at the second position, the opening/closing door 13 is located substantially at a middle position between the closed state and the fully-opened state of the opening/closing door 13. In other words, in the middle of the opening operation of the opening/closing door 13, the drive transmission member 181 is located at the second position.

When the opening/closing door 13 is further opened from the state where the drive transmission member 181 is located at the second position, the cylindrical cam 186 is further rotated and one end of the cylindrical cam 186 moves in a direction away from the cartridge B, so that the cylindrical cam 186 is inclined. When the cylindrical cam 186 is inclined, the drive transmission member 181 is also inclined in conjunction with the cylindrical cam 186. As a result, the output gear portion 181*a* of the inclined drive transmission member 181 is separated from the input gear portion 30*a* of the development roller gear 30 of the cartridge B.

At this time, the axial direction of each of the cylindrical cam 186 and the drive transmission member 181 is inclined with respect to the axial direction of the drive transmission member 181 located at the first position. In this state, the direction of the rotation axis of the drive transmission member 181 intersects with the direction of the rotation axis of the photosensitive drum 62. The position of the drive transmission member 181 in a state where the coupling engagement is released and the drive transmission member 181 is inclined is referred to as a third position of the drive transmission member 181. The attitude of the drive transmission member 181 in this case is referred to as a third attitude of the drive transmission member 181. In FIG. 21, the drive transmission member 181 is located at the third position.

When the drive transmission member 181 is located at the third position, the opening/closing door 13 is fully open. Accordingly, when the drive transmission member 181 is moved to the third position, the meshing of the output gear portion 81*a* with the input gear portion 30*a* is released, and thus the cartridge B can be easily pulled out from the apparatus body A.

<Operation of Cylindrical Cam when Coupling Engagement is Released>

An operation of the cylindrical cam 186 to be performed when the coupling engagement according to the present exemplary embodiment is released will be described with reference to FIGS. 22 to 25. FIGS. 22 to 25 are perspective views illustrating the cylindrical cam 186 as viewed from the outside (side of the support side plate 193).

Figure 22:
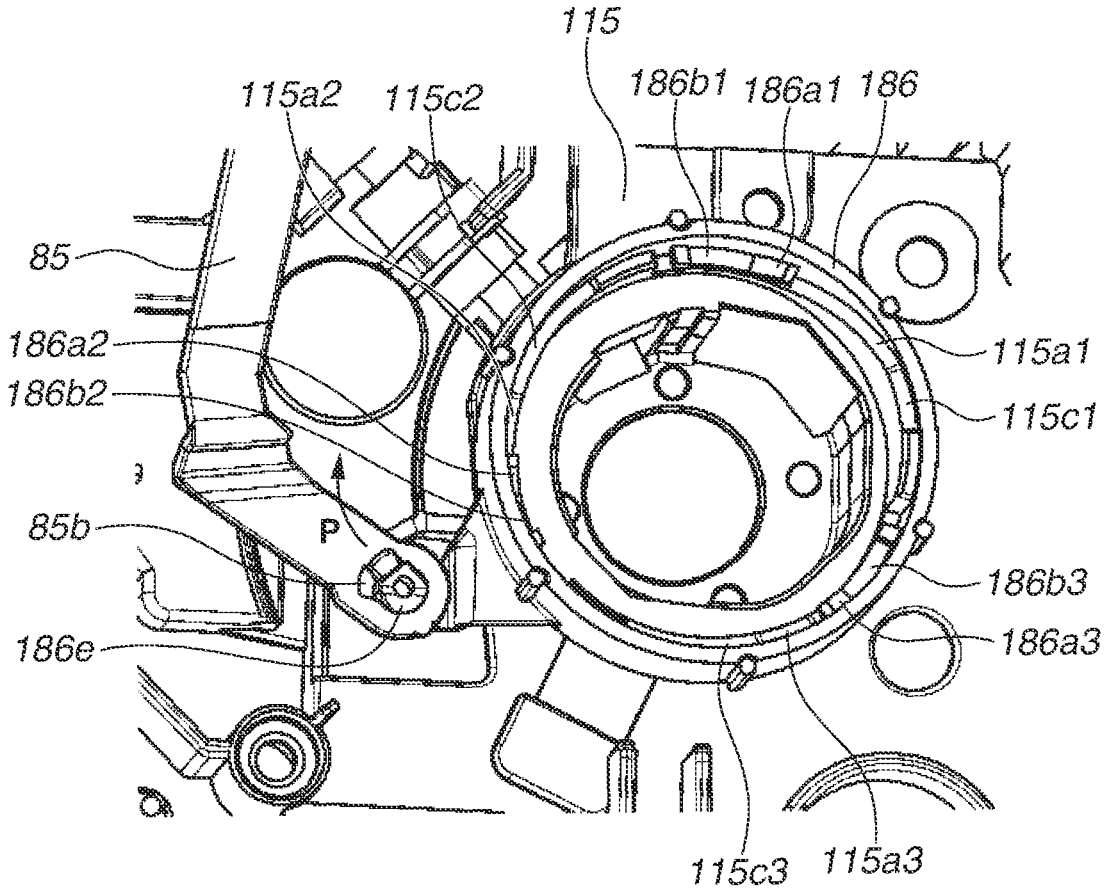
FIG. 22 is a perspective view illustrating a portion near a cylindrical cam when the drive transmission member according to the second exemplary embodiment is located at a first position.
Figure 23A:
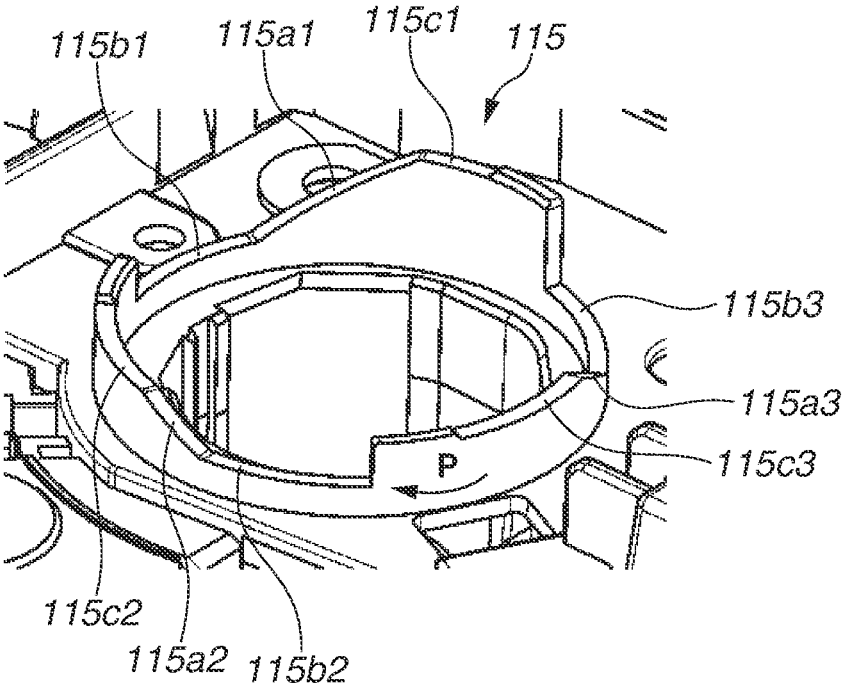
FIG. 23A is a view illustrating a cam shape of a first side plate according to the second exemplary embodiment.
Figure 23B:
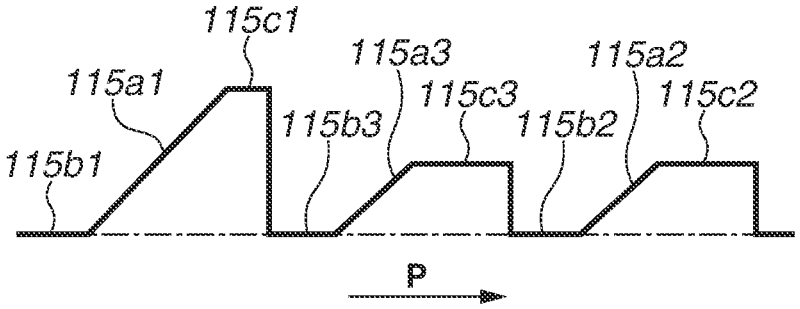
FIG. 23B is a schematic view illustrating the cam shape of the first side plate according to the second exemplary embodiment.
Figure 24:
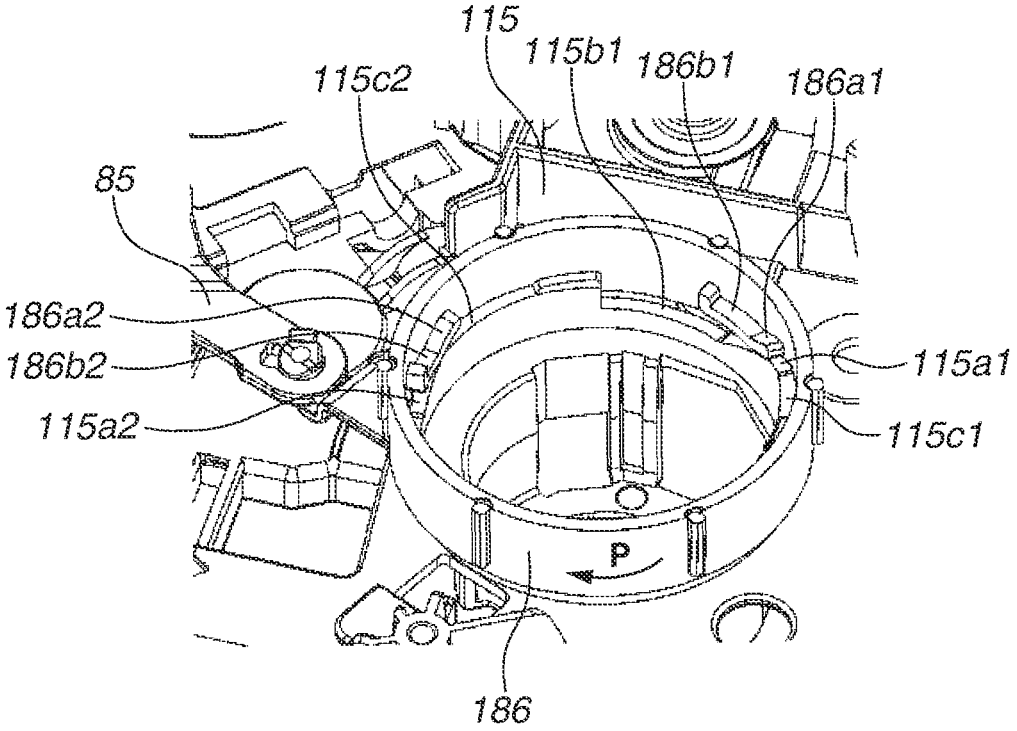
FIG. 24 is a perspective view illustrating a portion near the cylindrical cam when the drive transmission member according to the second exemplary embodiment is located at a second position.
Figure 25:
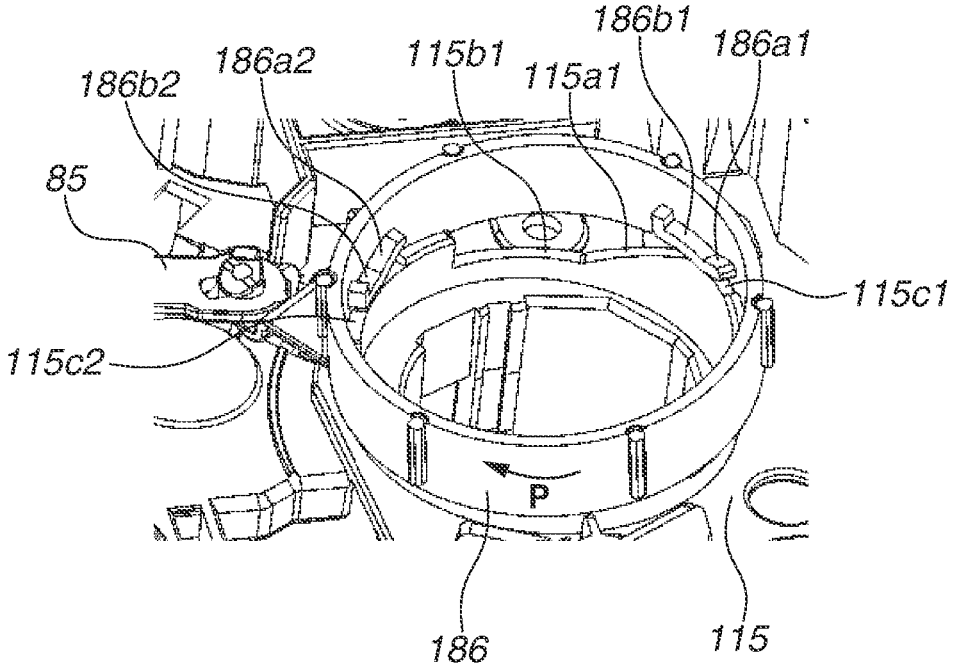
FIG. 25 is a perspective view illustrating a portion near the cylindrical cam when the drive transmission member according to the second exemplary embodiment is located at a third position.

FIG. 22 is a perspective view illustrating a portion near the cylindrical cam 186 when the drive transmission member 181 is located at the first position. FIGS. 23A and 23B are views each illustrating the shape of a cam provided on the first side plate 115 so that the cylindrical cam 186 according to the second exemplary embodiment is moved in the longitudinal direction. FIG. 23A is a view illustrating the cam shape of the first side plate 115. FIG. 23B is a schematic view illustrating the cam shape of the first side plate 115. FIG. 24 is a perspective view illustrating a portion near the cylindrical cam 186 when the drive transmission member 181 is located at the second position. FIG. 25 is a perspective view illustrating a portion near the cylindrical cam 186 when the drive transmission member 181 is located at the third position.

The state of the cylindrical cam 186 when the drive transmission member 181 is located at the first position will now be described with reference to FIG. 22.

As described above, the cylindrical cam 186 is mounted on the first side plate 115 so as to be rotatable and movable in the longitudinal direction, and is disposed to be located between the drive transmission member 181 and the first side plate 115.

Like in the first exemplary embodiment, the apparatus body A includes the cylindrical cam link 85 that is linked to the opening/closing door 13. The cylindrical cam 186 and the cylindrical cam link 85 are rotatably linked when a boss 186*e* provided on the cylindrical cam 186 engages with the mounting hole 85*b* provided on the cylindrical cam link 85.

When the drive transmission member 181 is located at the first position, the cylindrical cam 186 is disposed at a position close to the cartridge B. The cylindrical cam 186 includes three slope portions 186*a*1, 186*a*2, and 186*a*3 and three one end portions 186*b*1, 186*b*2, and 186*b*3, which are adjacent to the slope portions 186*a*1, 186*a*2, and 186*a*3, respectively. The shapes of the slope portion 186*a*1 and the one end portion 186*b*1 are respectively identical to the shapes of the slope portion 186*a*2 and the one end portion 186*b*2 and the shapes of the slope portion 186*a*3 and the one end portion 186*b*3.

As illustrated in FIG. 23A, the first side plate 115 has a cam shape for moving the cylindrical cam 186 in the longitudinal direction. Although the illustration of the cylindrical cam 186 is omitted in FIG. 23A, the cylindrical cam 186 is disposed on a side farther from the cartridge B than the cam shape of the first side plate 115 in the longitudinal direction.

The first side plate 115 includes three slope portions 115*a*1, 115*a*2, and 115*a*3 at positions opposed to the three slope portions 186*a*1, 186*a*2, and 186*a*3, respectively, of the cylindrical cam 186. Further, the first side plate 115 includes three one end portions 115*b*1, 115*b*2, and 115*b*3 at positions opposed to the one end portions 186*b*1, 186*b*2, and 186*b*3, respectively, of the cylindrical cam 186. The one end portions 115*b*1, 115*b*2, and 115*b*3 are connected to the one end sides of the slope portions 115*a*1, 115*a*2, and 115*a*3, respectively.

Further, three other end portions 115*c*1, 115*c*2, and 115*c*3 are disposed on the other end sides of the slope portions

115*a*1, 115*a*2, and 115*a*3, respectively. In the longitudinal direction, the other end portions 115*c*1, 115*c*2, and 115*c*3 are located at positions farther from the cartridge B than the one end portions 115*b*1, 115*b*2, and 115*b*3, respectively.

The one end portion 115*b*1, the slope portion 115*a*1, and the other end portion 15*c* are continuously formed. The one end portion 115*b*2, the slope portion 115*a*2, and the other end portion 115*c*2 are continuously formed. The one end portion 115*b*3, the slope portion 115*a*3, and the other end portion 115*c*3 are continuously formed.

The cam shape of the first side plate 115 will be described with reference to FIG. 23B. In FIG. 23B, the vertical direction indicates the longitudinal direction and the horizontal direction indicates the rotational direction (direction indicated by the arrow P) of the cylindrical cam 186. It can also be said that the vertical direction in FIG. 23B indicates the amount of movement of the cylindrical cam 186 in the longitudinal direction.

The three slope portions 115*a*1, 115*a*2, and 115*a*3 of the first side plate 115 have the same inclination angle (inclination angle in the rotational direction P). The length of the slope portion 115*a*1 is longer than the length of each of the slope portions 115*a*2 and 115*a*3. Accordingly, the other end portion 115*c*1 connected to the slope portion 115*a*1 is located at a higher position in the longitudinal direction than the other end portions 115*c*2 and 115*c*3. As a result, the other end portion 115*c*1 enables the cylindrical cam 186 to be located at a position farther from the cartridge B in the longitudinal direction than the other end portions 115*c*2 and 115*c*3.

Next, the state of the cylindrical cam 186 when the drive transmission member 181 is located at the second position will be described with reference to FIG. 24.

When the opening/closing door 13 is opened, the cylindrical cam link 85 is moved in conjunction with the opening/closing door 13 and the cylindrical cam 186 is rotated in the direction indicated by the arrow P. When the cylindrical cam 186 is rotated, each of the slope portions 186*a*1, 186*a*2, and 186*a*3 of the cylindrical cam 186 is moved toward the outside in the longitudinal direction along the corresponding one of the slope portions 115*a*, 115*a*2, and 115*a*3 of the first side plate 115. As a result, the cylindrical cam 186 is moved in a direction away from the cartridge B in the longitudinal direction. In this case, the cylindrical cam 186 is moved along the slope portions 115*a*1, 115*a*2, and 115*a*3 having the same angle, and thus is moved in parallel to the axial direction of the drive transmission member 181 located at the first position illustrated in FIG. 20 and is not inclined. That is, the drive transmission member 181 is located at the second position.

Next, the state of the cylindrical cam 186 when the drive transmission member 181 is located at the third position will be described with reference to FIG. 25.

When the opening/closing door 13 is further opened in a state where the drive transmission member 181 is located at the second position, the cylindrical cam 186 is further rotated in the direction indicated by the arrow P. When the cylindrical cam 186 is rotated, the slope portion 186*a*1 of the cylindrical cam 186 is moved to the outside in the longitudinal direction along the slope portion 115*a*1 of the first side plate 115. On the other hand, the slope portions 186*a*2 and 186*a*3 no longer contact the slope portions 115*a*2 and 115*a*3, respectively. Further, the one end portions 186*b*2 and 186*b*3 of the cylindrical cam 186 respectively contact the other end portions 115*c*2 and 115*c*3 of the first side plate 115. Accordingly, a portion where the one end portions 186*b*2 and 186*b*3 of the cylindrical cam 186 are disposed is no longer moved to the outside in the longitudinal direction.

When the opening/closing door 13 is fully open, the slope portion 186*a*1 does not contact the slope portion 115*a*1 of the first side plate 115 and the one end portion 186*b*1 of the cylindrical cam 186 contacts the other end portion 115*c*1 of the first side plate 115. Accordingly, a portion where the one end portion 186*b*1 is disposed is no longer moved to the outside in the longitudinal direction. As a result, the drive transmission member 181 is located at the third position and the cylindrical cam 186 is located at a position illustrated in FIG. 25.

Specifically, when the opening/closing door 13 is further opened in a state where the movement of each of the one end portions 186*b*2 and 186*b*3 of the cylindrical cam 186 in the longitudinal direction is finished, the one end portion 186*b*1 of the cylindrical cam 186 is moved in the direction away from the cartridge B in the longitudinal direction. As a result, as illustrated in FIG. 21, the cylindrical cam 186 is inclined. This is because the other end portion 115*c*1 of the first side plate 115 is located at a higher position than the other end portions 115*c*2 and 115*c*3 and thus the cylindrical cam 186 can be located at a position away from the cartridge B in the longitudinal direction.

In other words, the first side plate 115 includes the slope portions 115*a*1, 115*a*2, and 115*a*3 that cause the cylindrical cam 186 to move in the longitudinal direction. In the longitudinal direction, the distance the slope portion 115*a*1 (first moving portion) moves on the slope portion 186*a*1 (first moved portion) is longer than the distance the slope portions 115*a*2 and 115*a*3 (second moving portion) move on the slope portions 186*a*2 and 186*a*3 (second moved portion), respectively.

Further, in the longitudinal direction, the other end 115*c*1 of the first side plate 115 positions the one end portion 186*b*1 of the cylindrical cam 186, and the other end portions 115*c*2 and 115*c*3 of the first side plate 115 respectively position the one end portions 186*b*2 and 186*b*3 of the cylindrical cam 186. At this time, the one end portion 186*b*1 is located on the outer side in the longitudinal direction than the one end portions 186*b*2 and 186*b*3. In other words, in the longitudinal direction, the one end portion 186*b*1 is located at a position farther from the cartridge B than the one end portions 186*b*2 and 186*b*3. As a result, the drive transmission member 181 is located at the third position.

As described above, in the present exemplary embodiment, the drive transmission member 181 is moved from the first position to the second position in the axial direction of the drive transmission member 181, thereby releasing the coupling engagement. After the coupling engagement is released, the drive transmission member 181 is moved from the second position to the third position and the drive transmission member 181 is inclined.

Thus, separating the operation for releasing the coupling engagement from the operation for inclining the drive transmission member 181 makes it possible to reduce an operation force for releasing the coupling engagement, which leads to an improvement in usability. In addition, sound to be generated when the coupling engagement is released can be reduced.

Next, a third exemplary embodiment will be described. Descriptions of components of the third exemplary embodiment that are similar to the components of the first and second exemplary embodiments are omitted. In the third exemplary embodiment, members corresponding to the members described in the first and second exemplary embodiments are denoted by the same reference symbols as those of the first and second exemplary embodiments. Differences from the first and second exemplary embodiments will be mainly described in the third exemplary embodiment.

The apparatus body A according to the third exemplary embodiment includes a drive transmission member 281 (corresponding to the drive transmission member 81 according to the first exemplary embodiment and the drive transmission member 181 according to the second exemplary embodiment). The drive transmission member 281 includes a coupling concave portion 281*b*. The coupling concave portion 281*b* engages with the coupling convex portion 63*b* of the cartridge B. Like in the second exemplary embodiment, the engagement between the coupling concave portion 281*b* and the coupling convex portion 63*b* is hereinafter referred to as "coupling engagement". In addition, the definitions of the first position, the second position, and the third position of the drive transmission member 281 are the same as those described in the second exemplary embodiment.

In the present exemplary embodiment, an operation to be performed when the drive transmission member 281 is driven in a state where the coupling engagement of the drive transmission member 281 is released will be described in detail.

<Driving Operation in State where Coupling Engagement of Drive Transmission Member is Released>

An operation to be performed when the drive transmission member 281 according to the present exemplary embodiment is driven in a state where the coupling engagement is released will be described with reference to FIGS. 26A to 29.

Figure 26A:
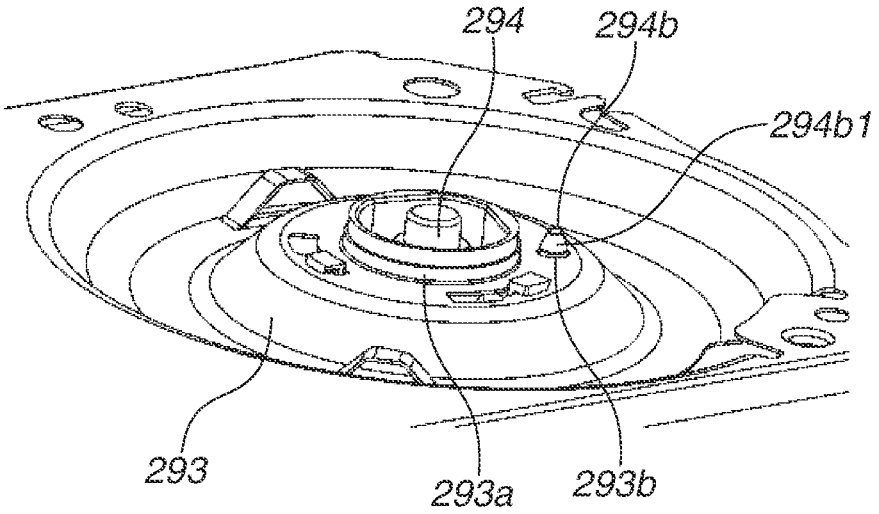
FIG. 26A is a perspective view illustrating a support side plate and a bearing according to a third exemplary embodiment.
Figure 26B:
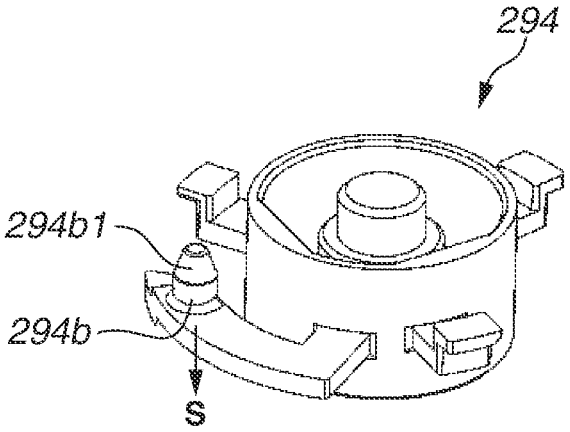
FIG. 26B is a perspective view illustrating the bearing according to the third exemplary embodiment.
Figure 27:
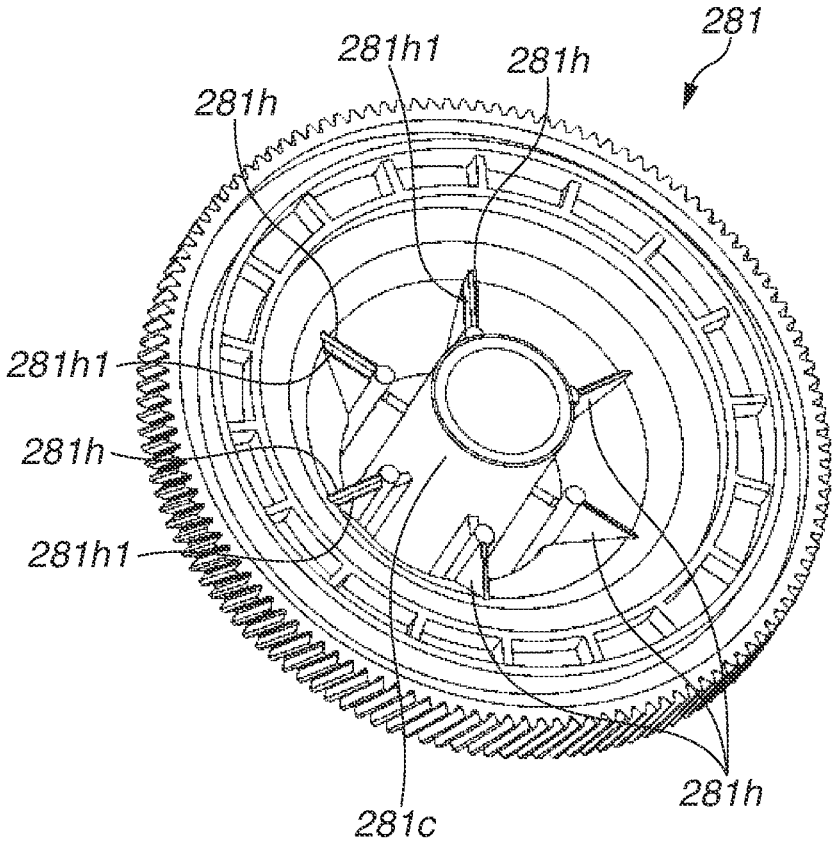
FIG. 27 is a perspective view illustrating a contact portion of a drive transmission member according to the third exemplary embodiment.
Figure 28:
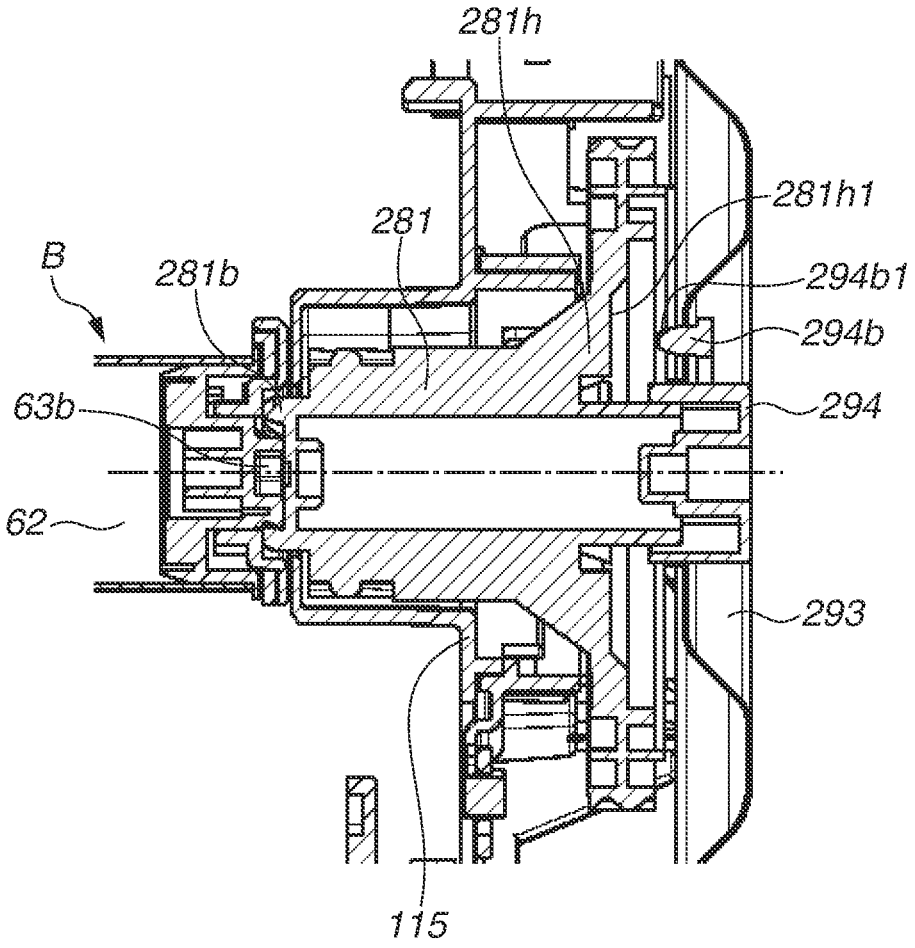
FIG. 28 is a sectional view illustrating a state where the drive transmission member according to the third exemplary embodiment is located at the first position.
Figure 29:
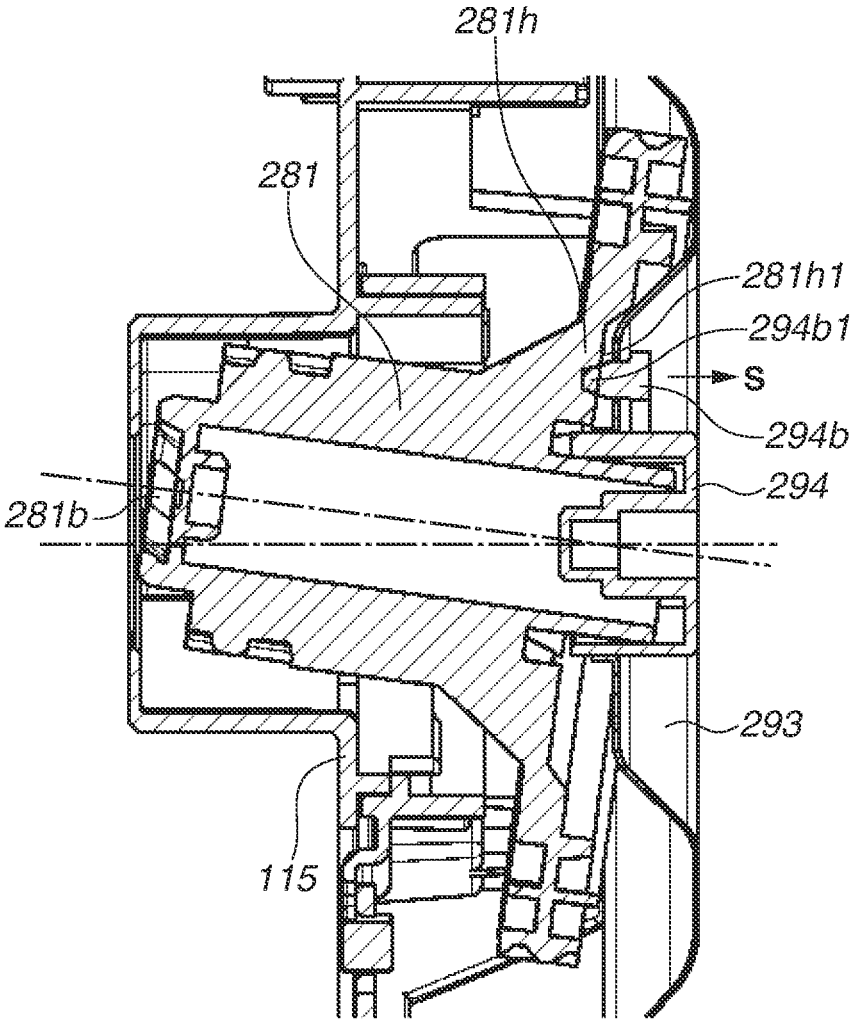
FIG. 29 is a sectional view illustrating a state where the drive transmission member according to the third exemplary embodiment is located at the second position.

FIGS. 26A and 26B are perspective views each illustrating a configuration of a bearing 294 that supports the drive transmission member 281 according to the third exemplary embodiment. FIG. 26A is a perspective view illustrating a support side plate 293 and the bearing 294 according to the third exemplary embodiment. FIG. 26B is a perspective view illustrating the bearing 294 according to the third exemplary embodiment. FIG. 27 is a perspective view illustrating contact portions 281*h* of the drive transmission member 281 according to the third exemplary embodiment. FIG. 28 is a sectional view illustrating a state where the drive transmission member 281 according to the third exemplary embodiment is located at the first position. FIG. 29 is a sectional view illustrating a state where the drive transmission member 281 according to the third exemplary embodiment is located at the second position.

A configuration for supporting one end portion 281*c* of the drive transmission member 281 will be described with reference to FIGS. 26A and 26B. The one end portion 281*c* of the drive transmission member 281 is located on the opposite side of the coupling concave portion 281*b* in the rotation axis direction of the drive transmission member 281. The apparatus body A includes the support side plate 293 and the bearing 294 that supports the drive transmission member 281. In the longitudinal direction, the support side plate 293 is provided on the outside of the first side plate 15.

As illustrated in FIG. 26A, the support side plate 293 is a sheet metal, and a hole portion 293*a* is provided by drawing this sheet metal. The bearing 294 is fitted into the hole portion 293*a* of the support side plate 293.

The one end portion 281*c* of the drive transmission member 281 is supported by the bearing 294, and thus the drive transmission member 281 is rotatably supported by the bearing 294.

To prevent the bearing 294 from being rotated with respect to the support side plate 293, the bearing 294 includes a convex portion 294*b* as a rotation stopping portion. On the other hand, the support side plate 293 is provided with a hole portion 293*b*. The convex portion 294*b* is fitted into the hole portion 293*b*, thereby regulating the rotation of the bearing 294. In other words, the bearing 294 is fixed so as not to be rotated with respect to the support side plate 293.

As illustrated in FIG. 26B, a slope portion 294*b*1 is provided at a leading end of the convex portion 294*b* of the bearing 294. As described below, when a load in the rotational direction of the drive transmission member 281 acts on the slope portion 294*b*1, the bearing 294 is deformed and the convex portion 294*b* is moved in the rotation axis direction of the drive transmission member 281. In the present exemplary embodiment, the convex portion 294*b* is configured to be deformed in the direction indicated by the arrow S (toward the support side plate 293).

Next, each contact portion 281*h* of the drive transmission member 281 will be described with reference to FIG. 27. The drive transmission member 281 includes six contact portions 281*h*. Each contact portion 281*h* has a rib shape that radially extends in the radial direction of the drive transmission member 281. The contact portions 281*h* have the same shape.

A slope portion 281*h*1 is provided at a leading end of the contact portion 281*h*. When the drive transmission member 281 is rotated in a state where the coupling engagement is released, the contact portion 281*h* is disposed at a position in contact with the convex portion 294*b* of the bearing 294.

As illustrated in FIG. 28, when the drive transmission member 281 is located at the first position, there is a gap between the contact portion 281*h* of the drive transmission member 281 and the convex portion 294*b* of the bearing 294 in the rotation axis direction of the drive transmission member 281. Accordingly, even when the drive transmission member 281 is rotated, the contact portion 281*h* of the drive transmission member 281 and the convex portion 294*b* of the bearing 294 do not contact each other.

In FIG. 29, the drive transmission member 281 is located at the third position. As illustrated in FIG. 29, when the drive transmission member 281 is rotated in a state where the coupling concave portion 281*b* is not engaged with the coupling convex portion 63*b*, the contact portion 281*h* of the drive transmission member 281 contacts the convex portion 294*b* of the bearing 294.

As described above, the slope portion 294*b*1 is provided at the leading end of the convex portion 294*b* of the bearing 294. When the drive transmission member 281 is rotated in a state where the coupling concave portion 281*b* is not engaged with the coupling convex portion 63*b*, the slope portion 281*h*1 of the drive transmission member 281 contacts the slope portion 294*b*1. As a result, in the longitudinal direction, the convex portion 294*b* of the bearing 294 is deformed in the direction indicated by the arrow S and is moved toward the support side plate 293. In other words, in the longitudinal direction, the convex portion 294*b* of the bearing 294 is moved in a direction away from the contact portion 281*h* of the drive transmission member 281.

When the convex portion 294*b* is moved, the convex portion 294*b* can pass over the contact portion 281*h* of the drive transmission member 281. Accordingly, even in a state where the coupling concave portion 281*b* is not engaged with the coupling convex portion 63*b*, the drive transmission member 281 can be rotated without causing a failure in the apparatus body A.

When the contact portion 281*h* of the drive transmission member 281 contacts the convex portion 294*b* of the bearing 294, collision sound is generated. If the drive transmission member 281 is rotated in the state where the coupling concave portion 281*b* is not engaged with the coupling convex portion 63*b*, such collision sound is repeatedly generated. This collision sound can be used as detection sound for detecting that the coupling concave portion 281*b* of the drive transmission member 281 is not engaged with the coupling convex portion 63*b*. In other words, the state where the collision sound is generated indicates a state where the coupling concave portion 281*b* is not engaged with the coupling convex portion 63*b*.

In other words, the apparatus body A includes a sound generation portion (corresponding to the convex portion 294*b* and the contact portion 281*h*). When the drive transmission member 281 is rotated in the state where the coupling concave portion 281*b* is not engaged with the coupling convex portion 63*b*, the convex portion 294*b* and the contact portion 281*h* contact each other, so that the sound generation portion generates sound. On the other hand, in a state where the drive transmission member 281 is located at the first position and the coupling concave portion 281*b* engages with the coupling convex portion 63*b*, the convex portion 294*b* and the contact portion 281*h* are separated from each other, and thus the sound generation portion does not generate sound.

The present exemplary embodiment described above illustrates a configuration in which sound is generated when the drive transmission member 281 is driven in the state where the coupling concave portion 281*b* is not engaged with the coupling convex portion 63*b*.

In the apparatus body A according to the present exemplary embodiment, it is possible to detect whether the coupling concave portion 281*b* is engaged with the coupling convex portion 63*b* based on the generation of sound.

Therefore, an operator can rapidly diagnose whether the coupling engagement is normal in the process of maintenance or repair of the apparatus body A and the cartridge B, or in an inspection in a manufacturing plant. As a result, it is possible to prevent the apparatus body A from being used in a state where the coupling engagement is abnormal, or it is possible to reduce a time for using the apparatus body A in a state where the coupling engagement is abnormal. Consequently, it is possible to prevent the drive transmission member 281 from being unevenly worn.

Further, in the configuration according to the present exemplary embodiment, each contact portion 281*h* of the drive transmission member 281 includes the slope portion 281*hl* and the slope portion 294*b*1 is provided at the leading end of the convex portion 294*b* of the bearing 294. Therefore, the convex portion 294*b* can be retracted in the rotation axis direction of the drive transmission member 281, and sound can be generated without causing a failure in the apparatus body A.

In the present exemplary embodiment, each contact portion 281*h* of the drive transmission member 281 is configured to contact the convex portion 294*b* of the bearing 294 in a state where the drive transmission member 281 is located at the third position, to thereby generate sound. However, each contact portion 281*h* of the drive transmission member 281 may be configured to contact the convex portion 294*b* of the bearing 294 in a state where the drive transmission member 281 is located at the second position, to thereby generate sound.

The scope of the invention is not intended to be limited only to the functions, materials, shapes, relative arrangements, and the like of the components described in the exemplary embodiments described above, unless otherwise specified.

Further, the components described in the exemplary embodiments described above can be appropriately combined, as needed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2019-180286, filed Sep. 30, 2019, and No. 2020-131914, filed Aug. 3, 2020, which are hereby incorporated by reference herein in their entirety.

What is claimed is:

1. An image forming apparatus comprising:

an apparatus body to which a cartridge including an input coupling portion and an input gear portion is detachably attached, the apparatus body including a mounting portion, the mounting portion being configured to accommodate the cartridge;

a drive transmission member configured to transmit a driving force to the cartridge, the drive transmission member being provided on the apparatus body and including an output coupling portion and an output gear portion, the output coupling portion being configured to engage with the input coupling portion and to be rotatable about a first axis, the output gear portion being configured to mesh with the input gear portion and to be rotatable about the first axis, the drive transmission member being coated with lubricant; and a cover portion configured to cover the drive transmission member, the cover portion being provided on the apparatus body and being located between the mounting portion and the drive transmission member, the cover portion including a first opening configured to expose the output coupling portion to allow the engagement of the output coupling portion with the input coupling portion, the cover portion including a second opening configured to expose the output gear portion to allow the meshing of the output gear portion with the input gear portion, wherein the output gear portion is separated from the input gear portion and the output coupling portion is separated from the input coupling portion when the cartridge is detached from the mounting portion.

2. The image forming apparatus according to claim 1, wherein the drive transmission member is movable between an engagement position and a retracted position, the engagement position being a position where the output coupling portion engages with the input coupling portion, the retracted position being a position where the output coupling portion is separated from the input coupling portion.

3. The image forming apparatus according to claim 2, wherein each of the output gear portion and the input gear portion is a helical gear, and wherein the drive transmission member is configured to move from the retracted position to the engagement position by a force generated when the output gear portion drives the input gear portion.

4. The image forming apparatus according to claim 2, wherein the cartridge further includes a first regulation portion configured to regulate a movement of the drive transmission member in a direction perpendicular to the first axis when the drive transmission member is located at the retracted position and the output gear portion drives the input gear portion, and wherein the cover portion further includes a third opening configured to expose the drive transmission member to the first regulation portion.

5. The image forming apparatus according to claim 4, wherein at least one of a pair of the first opening and the second opening, a pair of the first opening and the third opening, and a pair of the second opening and the third opening is connected.

6. The image forming apparatus according to claim 2, wherein the apparatus body further includes an inclination member configured to incline the drive transmission member in a direction in which the output gear portion is separated from the input gear portion.

7. The image forming apparatus according to claim 6, wherein the cartridge further includes a second regulation portion configured to be movable with respect to the input gear portion, wherein the second regulation portion is configured to urge the drive transmission member inclined by the inclination member to allow the meshing of the output gear portion with the input gear portion, and wherein the cover portion further includes a fourth opening configured to expose the drive transmission member to the second regulation portion.

8. The image forming apparatus according to claim 7, wherein at least one of a pair of the first opening and the second opening, a pair of the first opening and the fourth opening, and a pair of the second opening and the fourth opening is connected.

9. The image forming apparatus according to claim 6, wherein the inclination member constantly urges the drive transmission member in a state where the output coupling portion and the input coupling portion are engaged with each other.

10. The image forming apparatus according to claim 2, wherein the apparatus body further includes:

a mounting opening for mounting the cartridge on the mounting portion;

an opening/closing member configured to open and close the mounting opening; and a retracting member configured to move the drive transmission member to the retracted position in conjunction with an opening operation of the opening/closing member.

11. The image forming apparatus according to claim 1, wherein the first opening and the second opening are connected.

12. An image forming apparatus comprising:

an apparatus body to which a cartridge including an input coupling portion and an input gear portion is detachably attached, the apparatus body including a mounting portion, the mounting portion being configured to accommodate the cartridge;

a drive transmission member configured to transmit a driving force to the cartridge, the drive transmission member being provided on the apparatus body and including an output coupling portion and an output gear portion, the output coupling portion being configured to engage with the input coupling portion and to be rotatable about a first axis, the output gear portion being configured to mesh with the input gear portion and to be rotatable about the first axis, the drive transmission member being configured to be supplied with lubricant from the cartridge; and a cover portion configured to cover the drive transmission member, the cover portion being provided on the apparatus body and being located between the mounting portion and the drive transmission member, the cover portion including a first opening configured to expose the output coupling portion to allow the engagement of the output coupling portion with the input coupling portion, the cover portion including a second opening configured to expose the output gear portion to allow the meshing of the output gear portion with the input gear portion, wherein the output gear portion is separated from the input gear portion and the output coupling portion is separated from the input coupling portion when the cartridge is detached from the mounting portion.

13. The image forming apparatus according to claim 12, wherein the drive transmission member is movable between an engagement position and a retracted position, the engagement position being a position where the output coupling portion engages with the input coupling portion, the retracted position being a position where the output coupling portion is separated from the input coupling portion.

14. The image forming apparatus according to claim 13, wherein each of the output gear portion and the input gear portion is a helical gear, and wherein the drive transmission member is configured to move from the retracted position to the engagement position by a force generated when the output gear portion drives the input gear portion.

15. The image forming apparatus according to claim 13, wherein the cartridge further includes a first regulation portion configured to regulate a movement of the drive transmission member in a direction perpendicular to the first axis when the drive transmission member is located at the retracted position and the output gear portion drives the input gear portion, and wherein the cover portion further includes a third opening configured to expose the drive transmission member to the first regulation portion.

16. The image forming apparatus according to claim 15, wherein at least one of a pair of the first opening and the second opening, a pair of the first opening and the third opening, and a pair of the second opening and the third opening is connected.

17. The image forming apparatus according to claim 13, wherein the apparatus body further includes an inclination member configured to incline the drive transmission member in a direction in which the output gear portion is separated from the input gear portion.

18. The image forming apparatus according to claim 17, wherein the cartridge further includes a second regulation portion configured to be movable with respect to the input gear portion, wherein the second regulation portion is configured to urge the drive transmission member inclined by the inclination member to allow the meshing of the output gear portion with the input gear portion, and wherein the cover portion further includes a fourth opening configured to expose the drive transmission member to the second regulation portion.

19. The image forming apparatus according to claim 18, wherein at least one of a pair of the first opening and the second opening, a pair of the first opening and the fourth opening, and a pair of the second opening and the fourth opening is connected.

20. The image forming apparatus according to claim 17, wherein the inclination member constantly urges the drive transmission member in a state where the output coupling portion and the input coupling portion are engaged with each other.

21. The image forming apparatus according to claim 13, wherein the apparatus body further includes:

a mounting opening for mounting the cartridge on the mounting portion;

an opening/closing member configured to open and close the mounting opening; and a retracting member configured to move the drive transmission member to the retracted position in conjunction with an opening operation of the opening/closing member.

22. The image forming apparatus according to claim 13, wherein the first opening and the second opening are connected.

* * * * *